US012000680B2

(12) United States Patent
Shackelford et al.

(10) Patent No.: US 12,000,680 B2
(45) Date of Patent: Jun. 4, 2024

(54) CERAMIC TILE DESIGN IMPROVEMENT FOR CONFORMAL PERSONAL ARMOR

(71) Applicant: Verco Materials, LLC, Atlanta, GA (US)

(72) Inventors: Samuel Shackelford, Atlanta, GA (US); John Shupe, Atlanta, GA (US); Gabriel Todd, Atlanta, GA (US); Robert F. Speyer, Atlanta, GA (US)

(73) Assignee: VERCO MATERIALS, LLC, Atlanta, GA (US)

( * ) Notice: Subject to any disclaimer, the term of this patent is extended or adjusted under 35 U.S.C. 154(b) by 0 days.

(21) Appl. No.: 18/096,664

(22) Filed: Jan. 13, 2023

(65) Prior Publication Data

US 2023/0228535 A1 Jul. 20, 2023

Related U.S. Application Data

(60) Provisional application No. 63/299,584, filed on Jan. 14, 2022.

(51) Int. Cl.
*F41H 5/04* (2006.01)
*F41H 5/013* (2006.01)

(52) U.S. Cl.
CPC ..... *F41H 5/0492* (2013.01); *F41H 5/013* (2013.01)

(58) Field of Classification Search
CPC ..... F41H 5/013; F41H 5/0492
See application file for complete search history.

(56) References Cited

U.S. PATENT DOCUMENTS 921,352 A * 5/1909 Blaker et al. ..... F41H 1/02 152/196
1,021,804 A * 4/1912 Schneider ..... F41H 5/0492 152/196

(Continued)

FOREIGN PATENT DOCUMENTS

GB 2147977 A 5/1985

OTHER PUBLICATIONS

International Search Report dated May 2, 2023 in corresponding PCT International Application No. PCT/US2023/060632.

(Continued)

*Primary Examiner* — Joshua E Freeman
(74) *Attorney, Agent, or Firm* — OSTROLENK FABER LLP

(57) ABSTRACT

A tile to be used in an arrangement of identical tiles of an armor, the tile including an obverse face, a reverse face opposite the obverse face, and an endless edge between the obverse face and the reverse face, the endless edge being defined by a plurality of peripheral boundaries connected by curved sections, wherein the obverse face includes a first region and a second region each configured to be overlapped by a corresponding region of a reverse face of another tile, and a strike face region that is not overlapped by another tile, the first region and the second region being adjacent to the non-overlapped strike face region, the strike face region including a Y-shaped raised portion and no other raised portion or recessed portion, and the reverse face including a Y-shaped depression at a location corresponding to the location of the Y-shaped raised portion, and no other depression or raised portion.

18 Claims, 18 Drawing Sheets

(56) References Cited

U.S. PATENT DOCUMENTS

| | | | | |
|---|---|---|---|---|
| 1,282,411 | A * | 10/1918 | Golembiowski | F41H 1/02 152/196 |
| 6,170,378 | B1 * | 1/2001 | Neal | F41H 5/0492 428/221 |
| 6,500,507 | B1 * | 12/2002 | Fisher | F41H 5/0428 428/36.1 |
| 6,601,497 | B2 * | 8/2003 | Ghiorse | F41H 5/0414 89/36.02 |
| 8,047,116 | B2 * | 11/2011 | Neal | F41H 5/0435 428/221 |
| 8,087,143 | B2 * | 1/2012 | DiPietro | F41H 5/0492 29/458 |
| 8,434,396 | B1 * | 5/2013 | Wiley | F41H 5/013 89/36.01 |
| 9,322,621 | B2 * | 4/2016 | Cohen | F41H 5/0492 |
| 9,677,858 | B1 * | 6/2017 | Speyer | F41H 5/04 |
| 10,113,838 | B2 * | 10/2018 | Speyer | F41H 5/0492 |
| D880,776 | S * | 4/2020 | Greene | D29/100 |
| 11,047,651 | B2 * | 6/2021 | Speyer | F41H 5/0492 |
| 11,473,877 | B2 * | 10/2022 | Speyer | B32B 5/26 |
| 11,585,641 | B2 * | 2/2023 | Speyer | F41H 5/0442 |
| 11,644,283 | B2 * | 5/2023 | Contri | F41H 5/0492 89/36.02 |
| 2007/0234458 | A1 * | 10/2007 | Larsen | F41H 5/0492 2/2.5 |
| 2011/0239849 | A1 * | 10/2011 | Neal | B32B 3/06 89/917 |
| 2012/0090453 | A1 * | 4/2012 | Cohen | F41H 5/0492 89/917 |
| 2014/0305294 | A1 * | 10/2014 | Micarelli | F41H 5/0442 89/36.02 |
| 2016/0131457 | A1 * | 5/2016 | Bain | F41H 5/0492 89/36.02 |
| 2019/0390940 | A1 * | 12/2019 | Speyer | F41H 5/0492 |
| 2020/0033097 | A1 * | 1/2020 | Speyer | B32B 3/04 |

OTHER PUBLICATIONS

Written Opinion dated May 2, 2023 in corresponding PCT International Application No. PCT/US2023/060632.

* cited by examiner

Previous Design, 14° Tilt

Presently-disclosed Design, 7° Tilt

Top Oblique

Underside Oblique

Front

Side

Back

Ballistic Testing Report on Panel A

National Technical Systems
7447 W. 33rd St. N.
Wichita, KS 67205 U.S.A.
Phone (316) 632-1600 Fax (316) 632-1602
Email ustl@nts.com
www.nts.com/locations/wichita

HARD ARMOR STAND-ALONE PLATE:
P-BFS TEST

Date Received: November 22, 2022
Via: UPS
Returned Via: UPS

Record No.: VRM22017-2
Test Date: November 22, 2022
Customer: Verco Materials LLC

Test Conditions
Temperature: 70.2 °F
Humidity: 42 %

Clay Block No.: 7
Clay Block Size: 24" x 24" x 5.5"
Clay Temperature: 96.0 °F
Drop Average: 20.12 mm

Range 3
Muzzle to Screen 1: 39.30 ft.
Screen 1 - 4: 5.00 ft.
Screen 4 - Target: 5.70 ft.
Midpoint to Target: 8.20 ft.
Barrel Length: 26 in.

Test Standard: IAW Modified / Abbreviated NIJ 0101.06, July 2008
Threat Level: III Conditioning: No
Drop Test: No
Submersion: No

| Plate Description | | Shot / Projectile Description | | | | | | Chronograph | | Test Results |
|---|---|---|---|---|---|---|---|---|---|---|
| Manufacturer: | Verco Materials LLC | Shot No. | Shot Location | Degree Obliquity | Caliber | Bullet Weight (gr.) / Type | | TIME sec-ft | VELOCITY fps | Perforation BFS (mm) |
| Model No.: | NIJ-1122M80-2 | 1 | Bottom Right | 0° | | | | 178.3 | 2804 | Perforation |
| Lot No.: | N/A | 2 | Middle Right | 0° | | | | 180.4 | 2772 | 46.92 |
| Serial No.: | N/A | 3 | Top Right | 0° | 7.62mm NATO | 147 / FMJ (M80) | | 179.9 | 2779 | Perforation |
| Size (in.): | 10 x 12 | 4 | Middle Left | 0° | | | | 178.8 | 2796 | Perforation |
| Weight (lbs.): | 3.941 | 5 | Top Left | 0° | | | | 178.0 | 2809 | Perforation |
| | | 6 | Bottom Left | 0° | | | | 179.0 | 2793 | Perforation |

*This test was performed in accordance with the specification requirements listed in addition to any customer testing modifications or requests. The test results properly reflect the ballistic performance of the listed sample. This test report shall not be reproduced except in full without written approval of National Technical Systems.*

Test Remarks/Notes:
*Stand-Alone plate tested planar (without clay mound / build-up)
*Sample pre marked by customer

Sample Description:
*Customer Proprietary

Project Manager: Nold
Range Tech(s): Montgomery

Fig. 11

Ballistic Testing Report on Panel B

National Technical Systems
7447 W. 33rd St. N.
Wichita, KS 67205 U.S.A.
Phone (316) 832-1600 Fax (316) 832-1602
Email wstl@nts.com
www.nts.com/locations/wichita

HARD ARMOR STAND-ALONE PLATE:
P-BFS TEST

Date Received: September 22, 2022
Via: UPS
Returned Via: UPS

Record No.: VRM22013-2
Test Date: September 26, 2022
Customer: Verco Materials LLC

Test Conditions
Temperature: 70 °F
Humidity: 47 %

Clay Block No.: 7
Clay Block Size: 24" x 24" x 5.5"
Clay Temperature: 88 °F
Drop Average: 19.33 mm

Range 3
Muzzle to Screen 1: 39.30 ft.
Screen 1 - 4: 5.00 ft.
Screen 4 - Target: 5.70 ft.
Midpoint to Target: 8.20 ft.
Barrel Length: 24 in.

Test Standard: IAW Modified / Abbreviated NIJ 0101.06, July 2008
Threat Level: III Conditioning: No
Drop Test: No
Submersion: No

| Plate Description | | Shot / Projectile Description | | | | | Chronograph | | Test Results |
|---|---|---|---|---|---|---|---|---|---|
| Manufacturer: | Verco Materials LLC | Shot No. | Shot Location | Degree Obliquity | Caliber | Bullet Weight (gr.) / Type | YMS m-s | VELOCITY fps | Perforation BFS (mm) |
| Model No.: | NIJ-0922M80-2 | | | | | | | | |
| Lot No.: | N/A | 1 | Bottom Center | 0° | 7.62mm NATO | 147 / FMJ (M80) | 181.0 | 2762 | 42.78 |
| Serial No.: | N/A | 2 | Lower Right | 0° | | | 180.2 | 2775 | 34.02 |
| Size (in): | 10 x 12 | 3 | Lower Left | 0° | | | 173.3 | 2885 | 31.85 |
| Weight (lbs.): | 3.988 | 4 | Upper Right | 0° | | | 179.7 | 2782 | 23.52 |
| | | 5 | Upper Left | 0° | | | 179.1 | 2792 | 33.31 |
| | | 6 | Top Center | 0° | | | 179.6 | 2784 | 16.84 |

*This test was performed in accordance with the specification requirements listed in addition to any customer testing modifications or requests. The test results properly reflect the ballistic performance of the listed sample. This test report shall not be reproduced except in full without written approval of National Technical Systems.*

Test Remarks/Notes:
-Stand-Alone plate tested planar (without clay mound / build-up).
*Sample pre marked by customer

Sample Description:
-Customer Proprietary

Test Ammunition / Velocity Information:
Test Round: 7.62mm NATO, 147 gr. (9.6g) FMJ (U.S. Military M80)
Test Velocity: 2780 +/- 30 ft/s Project Manager: Montgomery
Range Tech(s): Zenger

Fig. 12

Previous Design, 10° Tilt

Presently-disclosed Design, 7° Tilt

Top Oblique

Underside Oblique

Front

Side

Back

CERAMIC TILE DESIGN IMPROVEMENT FOR CONFORMAL PERSONAL ARMOR

CROSS-REFERENCE TO RELATED APPLICATIONS

The present application claims priority to U.S. Provisional Application No. 63/299,584, filed Jan. 14, 2022, the entire contents of which are incorporated by reference.

FIELD OF THE INVENTION

The present invention relates to ceramic tiles for armor applications and in particular to ceramic tiles arranged in an imbricated pattern in an armor panel.

BACKGROUND OF THE INVENTION

U.S. Pat. No. 8,434,396 discloses a ceramic tile design, which can be used to devise an imbricated arrangement of tiles integrated with ballistic fabric to realize an effective conformable personal armor panel to defeat rifle rounds. An armor system using the tiles of U.S. Pat. No. 8,434,396 has earned a National Institute of Justice Certification as a Level III armor (Verco Materials, LLC, model UrbanShieldMH).

U.S. Pat. No. 11,473,877 discloses a curved ceramic tile design, which can be used to devise an imbricated arrangement of tiles integrated with ballistic fabric to realize an effective personal armor panel to defeat rifle rounds. U.S. Pat. No. 11,473,877 discloses a ceramic tile design, which, when assembled with other tiles, forms an imbricated pattern that follows a curve. The tiles of U.S. Pat. No. 11,473,877 are particularly useful for an armor panel that follows a small radius of curvature of a part of a human body such as the transition from the front torso to the side torso, and the outer regions of the upper arm.

SUMMARY OF THE INVENTION

Weight is an important factor for police operators who wear rifle armor protection, as excessive weight can become fatiguing and affect performance when the armor is worn for extended periods.

It is an object of the present invention to provide a tile design which has equivalent ballistic effectiveness, conformability, and multi-hit stopping capability of the tiles of the prior art with a markedly reduced weight.

The objective of the present invention was accomplished: a) by reducing the weight of the tile, b) by decreasing the tilt angle of the imbricated assembly of tiles so that the assembly of tiles covers more area of the wear surface, c) by reducing the extent of tile overlap in specific locations, and d) by making the thickness of the tile more uniform.

A tile according to the present invention has an obverse face, a reverse face opposite the obverse face, and an endless edge between the obverse face and the reverse face, the endless edge being defined by a plurality of peripheral boundaries connected by curved sections, wherein the obverse face includes a first region and a second region each configured to be overlapped by a corresponding region of a reverse face of another tile, and a strike face region that is not overlapped by another tile, the first region and the second region being adjacent to this non-overlapped region. The strike face region includes a Y-shaped raised portion and no other raised portion or recessed portion, and the reverse face includes a Y-shaped depression at a location corresponding to the location of the Y-shaped raised portion, and no other depression or raised portion.

Preferably the tile is symmetric about a center line that divides the Y-shaped raised portion into two symmetric portions.

The first region and the second region may each slope downwardly from the strike face region toward respective first and second peripheral boundaries and each is overlapped by corresponding regions of a respective tile when the tile and the respective tiles are arranged in an imbricated arrangement.

The tile may be made of sintered boron carbide or sintered silicon carbide. Aluminum oxide is another possible material that could be used for making the tile.

The Y-shaped raised portion may be raised high enough to intercept a projectile travelling at an oblique angle to protect a seam defined by a tile overlapping the first region or the second region.

The first region and the second region may slope at an inclination that would permit assembly of an imbricated arrangement of additional tiles, each additional tile being identical to the tile, and a first tile of the additional tiles overlaps the first region and a second tile of the additional tiles overlaps the second region.

The imbricated arrangement may follow a curved contour with a radius of curvature in the range of two to six inches.

The tile may have an edge to center thickness ratio in the range 0.49 to 0.90.

An armor made with a plurality of tiles according to the present invention may have the tiles cooperatively arranged to realize a flexible body, each tile comprising an obverse face, a reverse face opposite the obverse face, and an endless edge between the obverse face and the reverse face, the endless edge being defined by a plurality of peripheral boundaries connected by curved sections, wherein the obverse face includes a first region and a second region each configured to be overlapped by a corresponding region of a reverse face of a respective tile from the plurality of tiles, and a strike face region that is not overlapped by another tile from the plurality of tiles, the first region and the second region being adjacent the non-overlapped strike face region, the strike face region including a Y-shaped raised portion and no other raised portion or recessed portion, and the reverse face including a Y-shaped depression at a location corresponding to the location of the Y-shaped raised portion, and no other depression or raised portion.

The first region and the second region may each slope downwardly from the strike face region toward respective first and second peripheral boundaries and each may be overlapped by a corresponding region on the reverse face of a respective tile from the plurality of tiles.

The tiles in the armor may be made of sintered boron carbide, or sintered silicon carbide.

The armor may be configured as an armor blanket.

Each tile in the armor may be wrapped in an epoxy-impregnated carbon fiber fabric, and the wrapped tiles may be arranged in an imbricated pattern and held in place by encapsulation in an adhesive-coated aramid fabric.

The Y-shaped raised portion may be raised high enough to intercept a projectile travelling at an oblique angle to protect a seam defined by a tile overlapping the first region or the second region.

The first and the second regions of the tiles in the armor may be sloped to permit an arrangement that can follow a curved contour with a radius of curvature in the range of two to six inches.

Each curved tile in the armor may have an edge to center thickness ratio in the range 0.49 to 0.90.

Weight-saving was realized by forming a Y-shaped depression on the wear face of the tile (the side closest to the wearer) opposite a Y-shaped raised portion on the strike face region (the surface opposite the wear side, which is intended to intercept the projectile). The edge-to-center thickness ratio was also increased to yield an imbricated pattern with more uniform ballistic performance at all locations along the imbricated pattern.

Ballistic tests showed that while a 4.9 lb torso panel using sintered boron carbide tiles according to the prior art was ballistically sound against six M80 ball rounds shot at standard muzzle velocity, the same result was achieved with a 3.9 lb torso panel of the same coverage area using tiles according to the present invention with the same sintered boron carbide.

Other features and advantages of the present invention will become apparent from the following description of the invention which refers to the accompanying drawings.

BRIEF DESCRIPTION OF THE DRAWING(S)

FIG. 1A shows top (having the strike face region) and side views, with dimensions indicated, of a tile according to the prior art (U.S. Pat. No. 8,434,396).

FIG. 1B shows top (having strike face region) and side views of a curved tile, with dimensions indicated, according to the prior art (U.S. Pat. No. 11,473,877).

FIG. 11 shows data from a ballistic test report on the imbricated arrangement of FIG. 9, with a panel areal density of 5.25 psf, showing five projectile perforations among six shots of the M80 ball round at standard muzzle velocity. The panel was mounted on a clay surface, with testing following the NIT 0101.06 protocol.

FIG. 12 shows data from a ballistic test report on the imbricated arrangement of FIG. 10, with a panel areal density of 5.25 psf, showing all six projectiles stopped. The panel was mounted on a clay surface, with testing following the NIJ 0101.06 protocol.

Figure 13A:
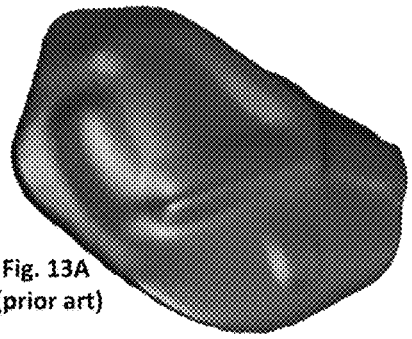
Fig. 13A (prior art)
FIG. 13A is a perspective view of the strike face region of a curved tile according to prior art (FIG. 1B) tilted at an angle corresponding to the angle at which the tile would be tilted when present in an imbricated arrangement.
Figure 15A:
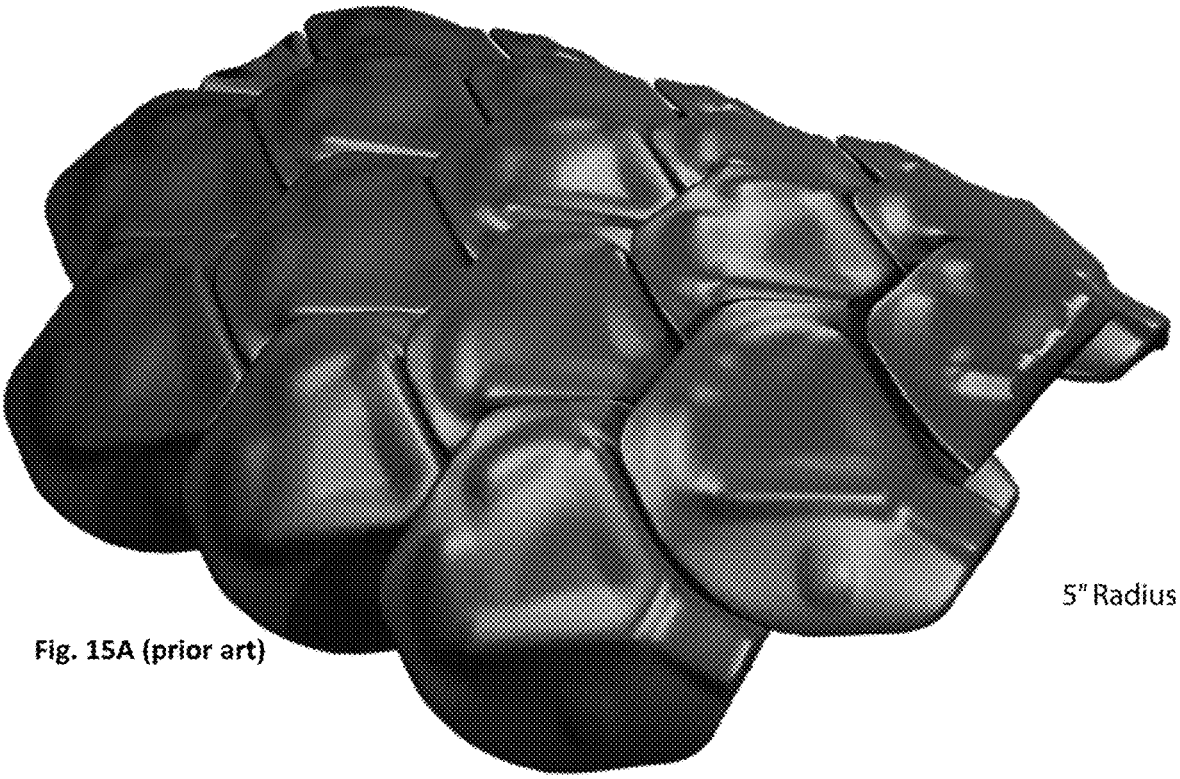
Fig. 15A (prior art)
Figure 15B:
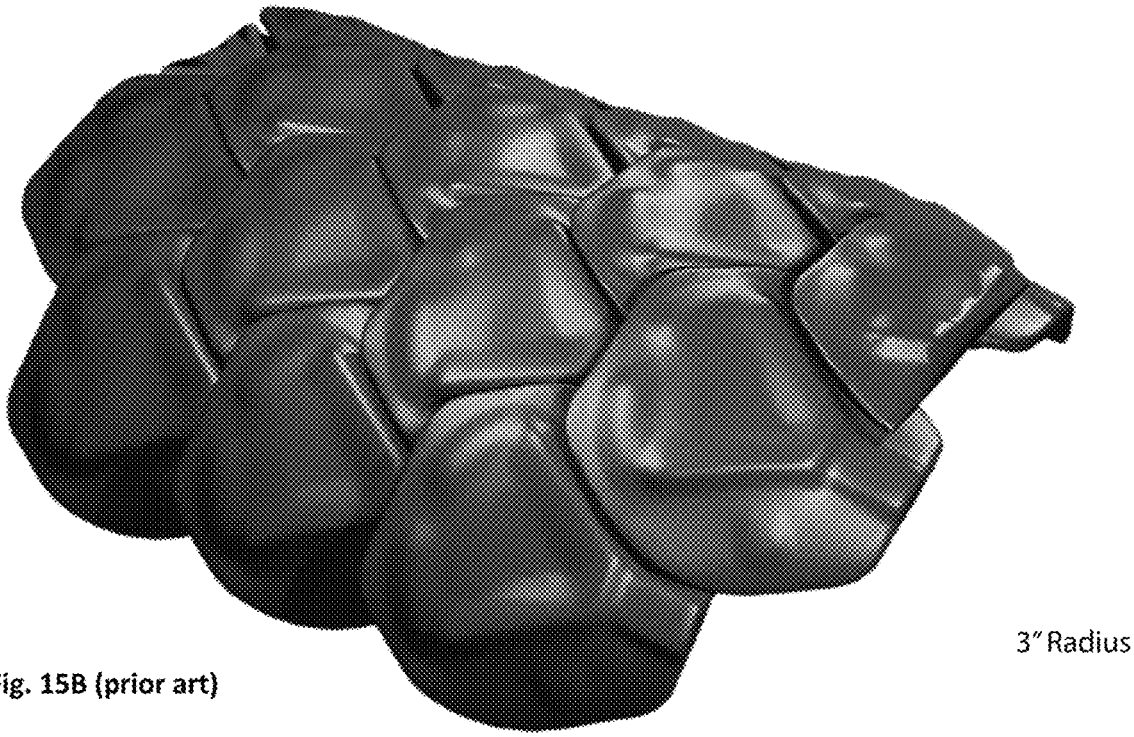
Fig. 15B (prior art)

FIG. 15A shows a top oblique view of an imbricated arrangement of tiles according to FIG. 13A following a contour with a 5" radius of curvature and FIG. 15B shows a top oblique view of an imbricated arrangement of tiles according to FIG. 13A following a contour with a 3" radius of curvature. It can be seen in FIGS. 15A and 15B that the curved tile design prohibits oblique gaps from opening adjacent to the outsides of the Y-shaped raised portions, as a result of forming an imbricated array to follow these contours.

Figure 13F:
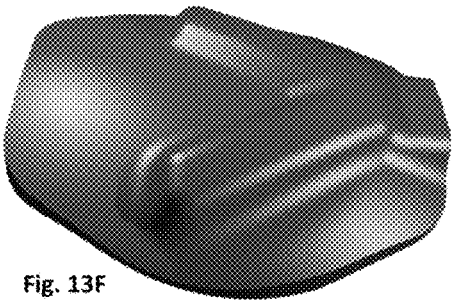
FIG. 13F is a perspective view of the strike face region of a curved tile according to present invention (FIG. 1D) tilted at an angle corresponding to the angle at which the tile would be tilted when present in an imbricated arrangement.
Figure 13B:
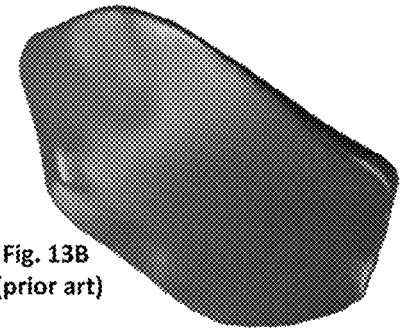
Fig. 13B (prior art)
FIG. 13B is a perspective underside (opposite the strike face region) view of the tile of FIG. 13A.
Figure 13G:
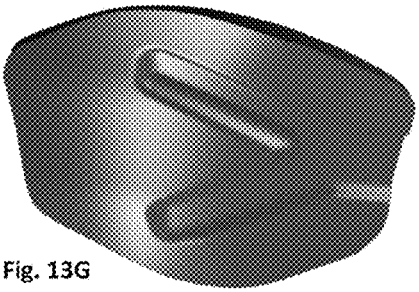
FIG. 13G is a perspective underside (opposite the strike face region) view of the tile of FIG. 13F.
Figure 13C:
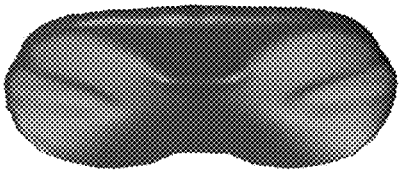
Fig. 13C (prior art)
FIG. 13C is a front view of the tile of FIG. 13A.
Figure 13H:
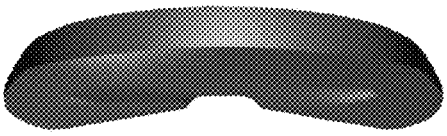
FIG. 13H is a front view of the tile of FIG. 13F.
Figure 13D:
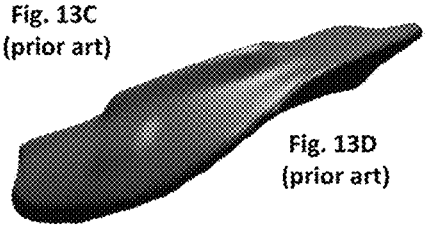
Fig. 13D (prior art)
FIG. 13D is a side view of the tile of FIG. 13A.
Figure 13I:
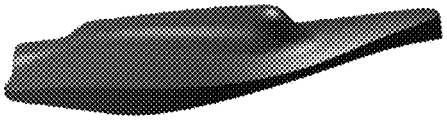
FIG. 13I is a side view of the tile of FIG. 13F.
Figure 13E:
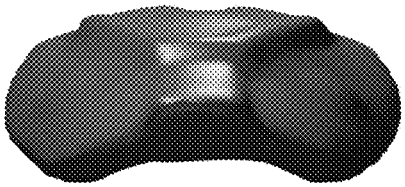
Fig. 13E (prior art)
FIG. 13E is a back view of the tile of FIG. 13A.
Figure 13J:
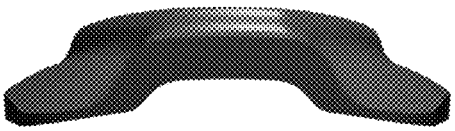
FIG. 13J is a back view of the tile of FIG. 13F.
Figure 16A:
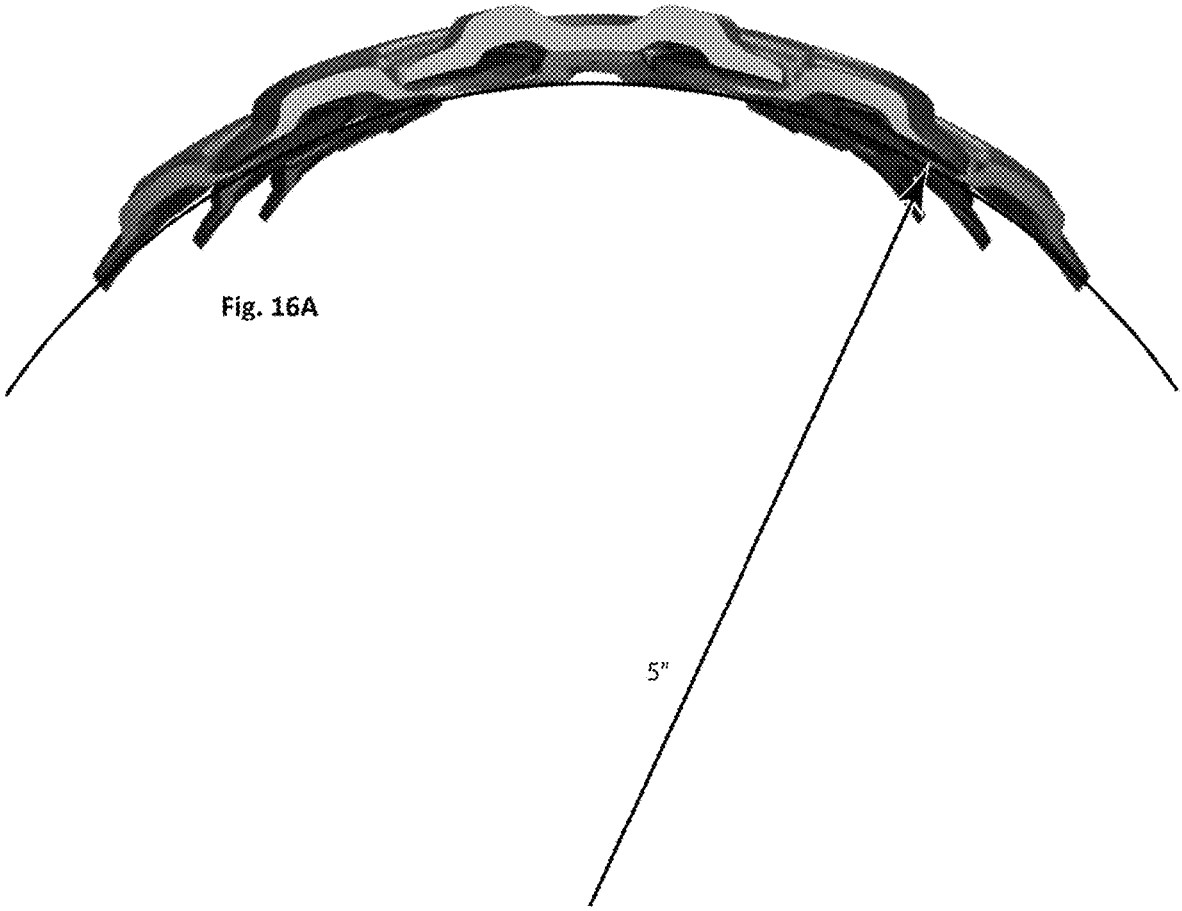

FIG. 16A shows a front view of an imbricated pattern of tiles according to FIG. 13F following a contour with a 5" radius of curvature.

Figure 16B:
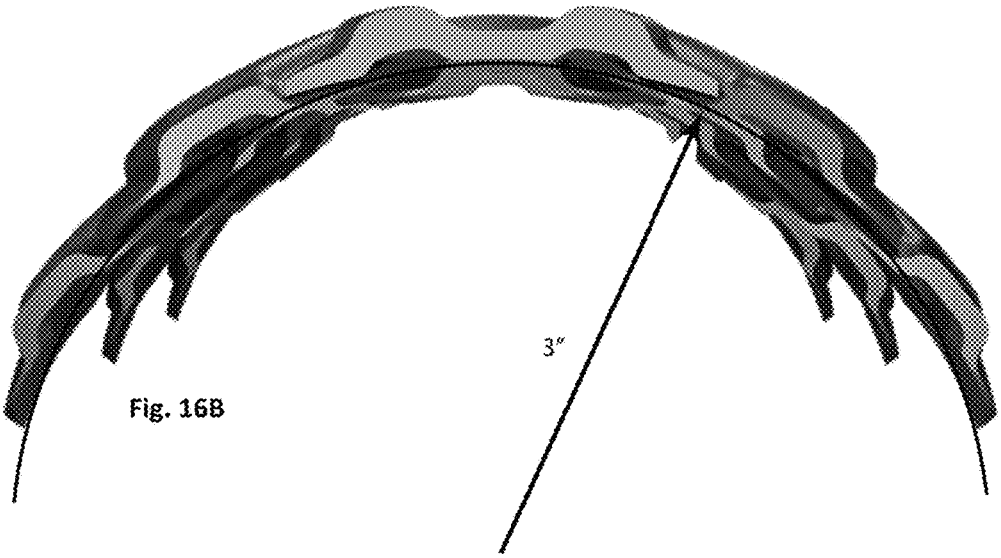

FIG. 16B shows a front view of an imbricated pattern of tiles according to FIG. 13F following a contour with a 3" radius of curvature.

Figure 17A:
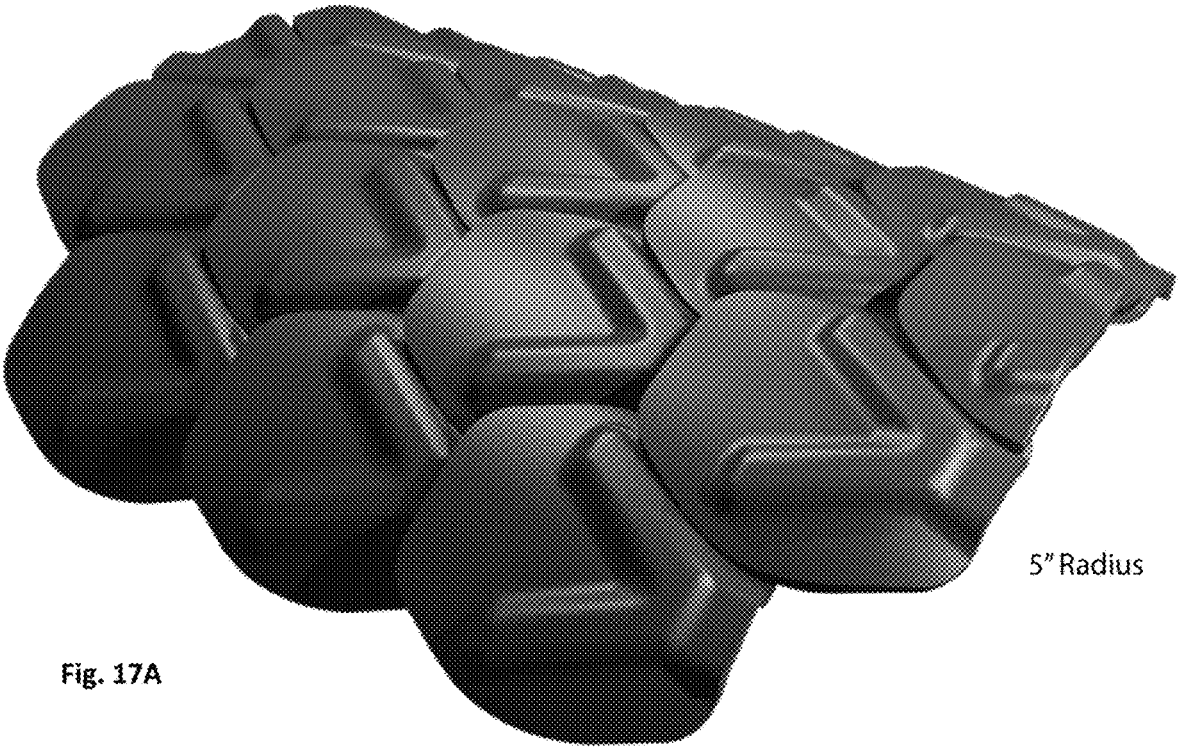
Figure 17B:
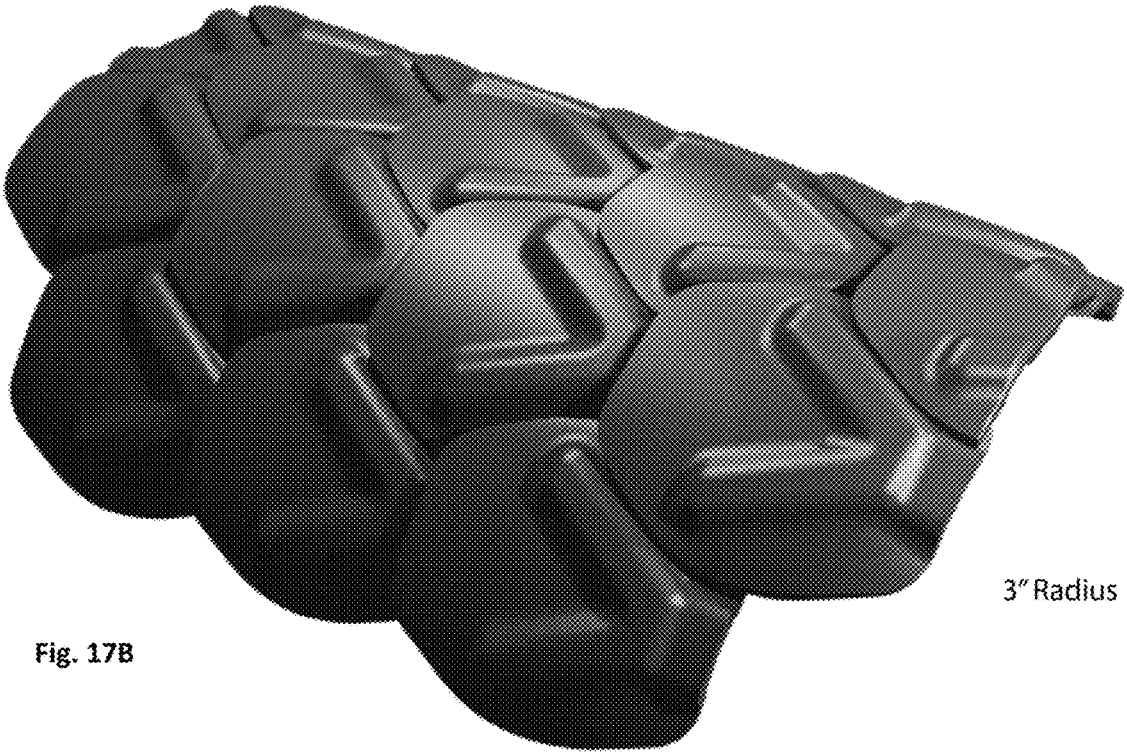

FIG. 17A shows a top oblique view of an imbricated arrangement of tiles according to FIG. 13F following a contour with a 5" radius of curvature and FIG. 17B shows a top oblique view of an imbricated arrangement of tiles according to FIG. 13F following a contour with a 3" radius of curvature. It can be seen in FIGS. 17A and 17B that the curved tile design prohibits oblique gaps from opening adjacent to the outsides of the Y-shaped raised portions, as a result of forming an imbricated array to follow these contours.

DETAILED DESCRIPTION OF EMBODIMENTS OF THE INVENTION

Figure 1A:
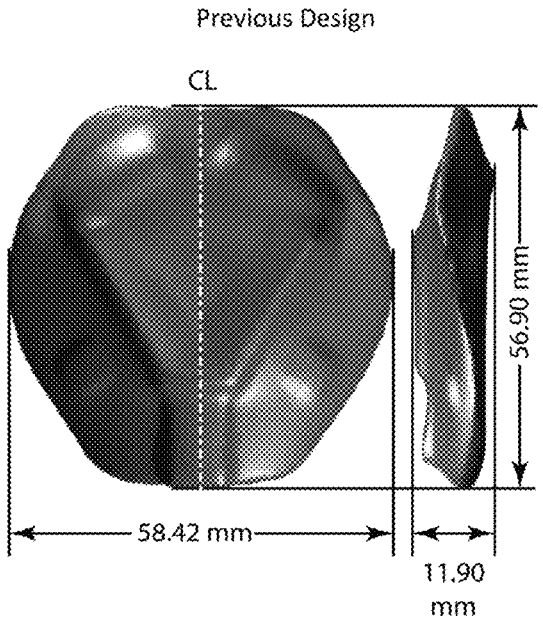
Fig. 1A (prior art)
FIG. 1C shows top (having the strike face region) and side views, with dimensions indicated, of an example of a tile according to the present invention.
FIG. 1D shows top (having the strike face region) and side views with dimensions indicated, of a curved tile according to the present invention.
FIG. 1E shows a perspective view of an obverse side of a tile according to the present invention.
FIG. 1F shows a perspective view of the reverse side of a tile according to the present invention.
Figure 1C:
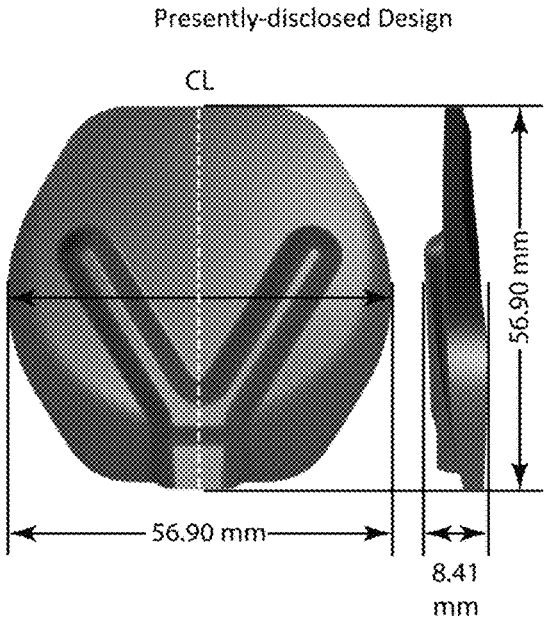
Figure 1B:
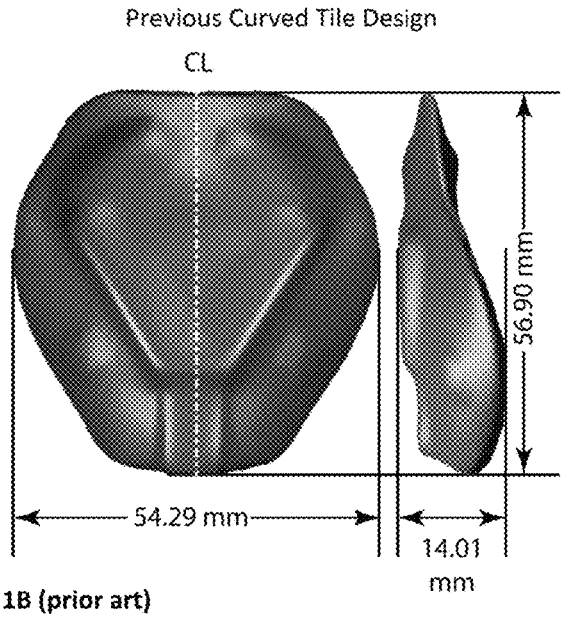
Fig. 1B (prior art)

FIGS. 1A and 1B show the dimensions of a typical tile according to U.S. Pat. Nos. 8,434,396, and 11,473,877 respectively.

Figure 1D:
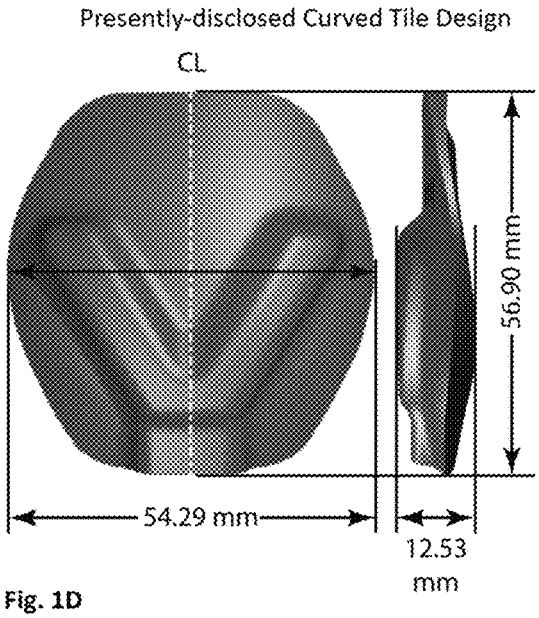

FIGS. 1C and 1D show the typical dimensions for a tile according to the present invention.

The tiles according to the prior art and the tiles according to the present invention are six-sided with rounded corners and the length of the sides of the tiles according to the present invention being closer to equal. The tile design according to the present invention and the prior art are both symmetrical with respect to a center line CL that symmetrically divides a Y-shaped raised portion C (see FIGS. 1A, 1C, 2A, and 2C) on the strike face region of the tile.

Figure 1E:
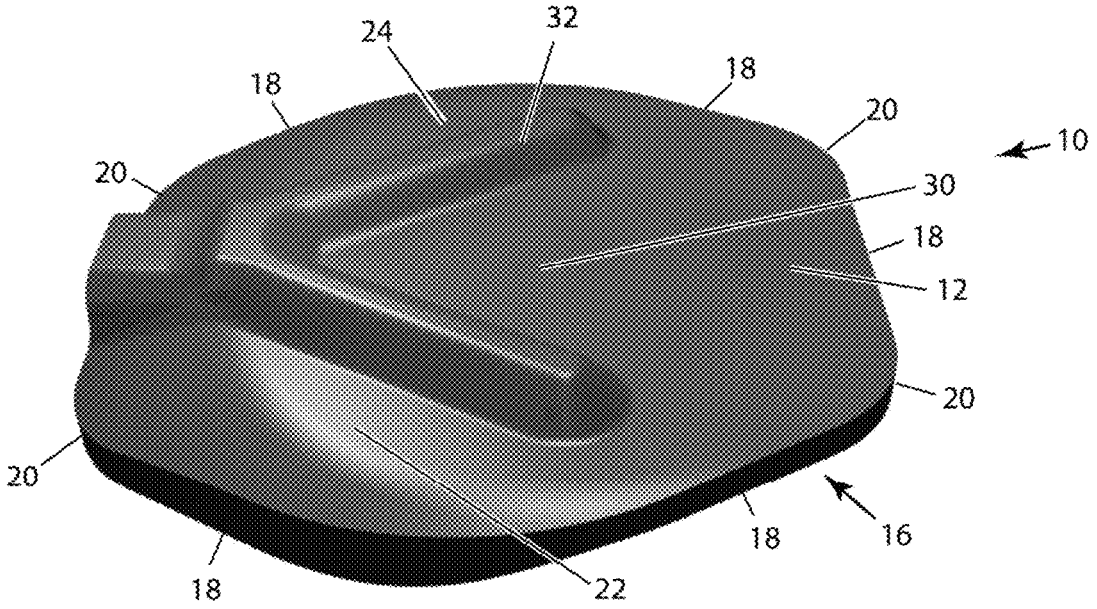
Fig. 1E (prior art)
Figure 1F:
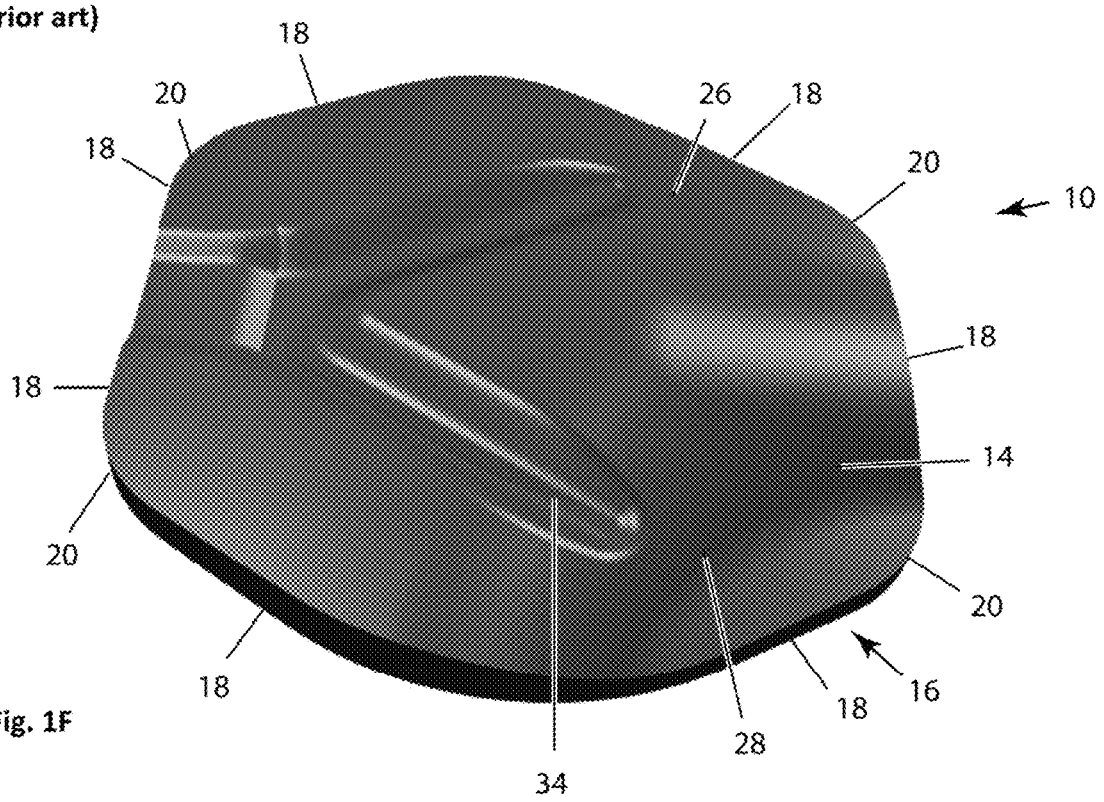

Referring to FIGS. 1E and 1F, a tile 10 according to the present invention has an obverse face 12, a reverse face 14 opposite the obverse face, and an endless edge 16 between the obverse face 12 and the reverse face 14, the endless edge 16 being defined by a plurality of peripheral boundaries 18 connected by curved sections 20, wherein the obverse face 12 includes a first region 22 and a second region 24 each configured to be overlapped by a corresponding regions 26 and 28 of a reverse face of another tile, and a strike face region 30 that is not overlapped by another tile, the first region 22 and the second region 24 being adjacent this non-overlapped region of the strike face region 30, the strike face region including a Y-shaped raised portion 32 and no other raised portion or recessed portion, and the reverse face 14 including a Y-shaped depression 34 at a location corresponding to the location of the Y-shaped raised portion 32, and no other depression or raised portion.

Figure 2A:
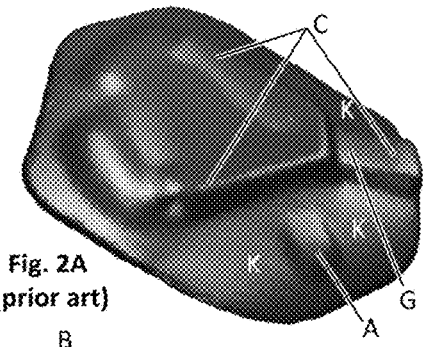
Fig. 2A (prior art)
FIG. 2A is a perspective view of the strike face region of a tile according to prior art tilted at an angle corresponding to the angle at which the tile would be tilted (14°) when present in an imbricated arrangement.
Figure 2F:
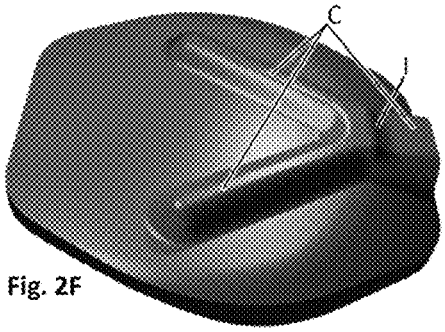
FIG. 2F is a perspective view of the strike face region of a tile according to present invention tilted at an angle corresponding to the angle at which the tile would be tilted (7°) when present in an imbricated arrangement.
Figure 2B:
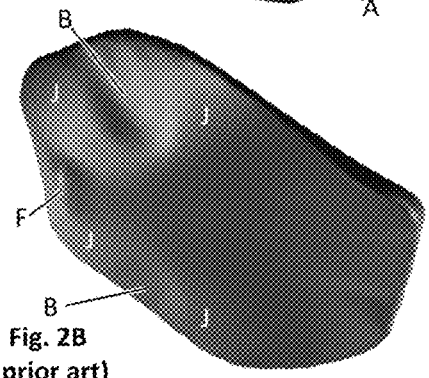
Fig. 2B (prior art)
FIG. 2B is a perspective underside (opposite the strike face region) view of the tile of FIG. 2A.
Figure 2G:
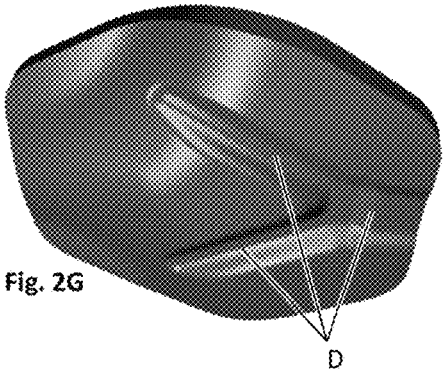
FIG. 2G is a perspective underside (opposite the strike face region) view of the tile of FIG. 2F.
Figure 2C:
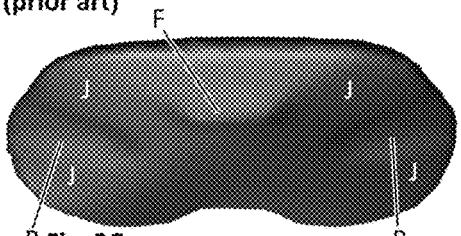
Fig. 2C (prior art)
FIG. 2C is a front view of the tile of FIG. 2A.
Figure 2H:
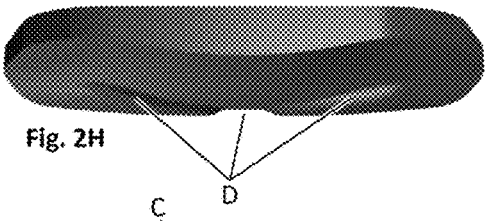
FIG. 2H is a front view of the tile of FIG. 2F.
Figure 2D:
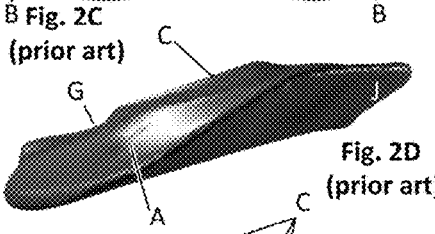
Fig. 2D (prior art)
FIG. 2D is a side view of the tile of FIG. 2A.
Figure 2I:
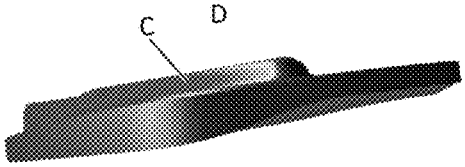
FIG. 2I is a side view of the tile of FIG. 2F.
Figure 2E:
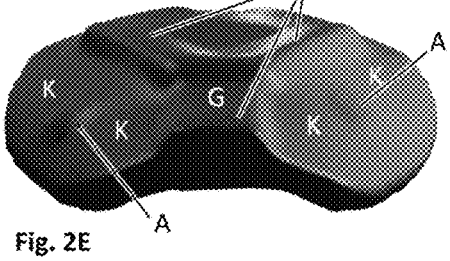
Fig. 2E (prior art)
FIG. 2E is a back view of the tile of FIG. 2A.
Figure 2J:
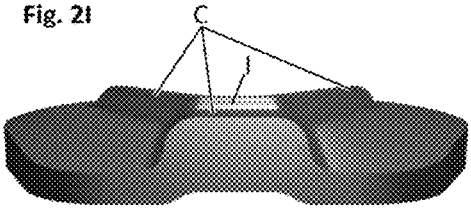
FIG. 2J is a back view of the tile of FIG. 2F.

Referring to FIGS. 2A-2J, the prior art tile (FIG. 2A) includes mounds A that were intended for imbricated array alignment by fitting into cavities B (FIG. 2B). A tile according to the present invention does not have the mounds or the corresponding cavities (FIGS. 2F and 2G).

Referring to FIGS. 2A and 2F, a tile according to the prior art and a tile according to the present invention both have a Y-shaped raised portion C (feature 32 in FIG. 1E) on the strike face region (the strike face region faces away from the wearer's body), which provides coverage in an imbricated arrangement against projectiles oriented at oblique angles that would otherwise exploit an open gap between adjacent tiles (discussed further below with reference to FIGS. 3A to 4B).

In the prior art tile design, the Y-shaped raised portions C represent a significant local step-increase in tile thickness.

In a tile design according to the present invention, a Y-shaped depression D (FIGS. 2G-2H) on the wear face (the side which faces the wearer's body) is aligned beneath the Y-shaped raised portion C (FIGS. 2F, 2I, 2J) on the strike face region. A Y-shaped depression is not present in a tile according to the prior art.

The Y-shaped depression D reduces the thickness of the tile in the regions of the Y-shaped raised portion C to that which is similar to the tile thicknesses at regions away from the Y-shaped raised portion. The provision of the Y-shaped depression D contributes to weight savings.

Figure 3A:
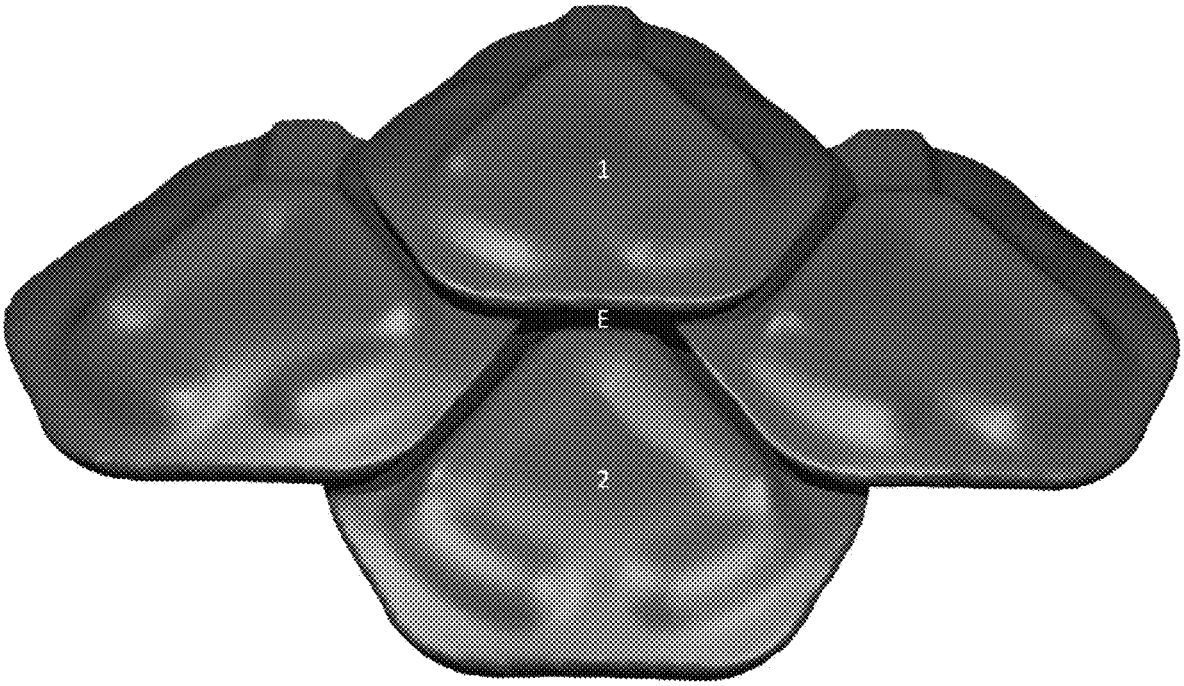
Fig. 3A (prior art)
FIG. 3A shows four tiles according to FIG. 2A in an imbricated arrangement, the seam between the upper 1 and lower 2 tiles in a column of tiles being marked with letter E.

FIG. 3A shows four tiles according to the prior art nested together in an imbricated pattern. The seam E between the upper tile 1 and the lower tile 2 represents a location with the potential for a projectile, oriented at a certain angle, to pass through the armor. In the prior art, to protect against this vulnerability, the underside of the upper tile 1 was provided with a tooth feature F (FIG. 2B), which was received in a concave-shaped well G (FIG. 2D) of the lower tile 2.

Figure 3B:
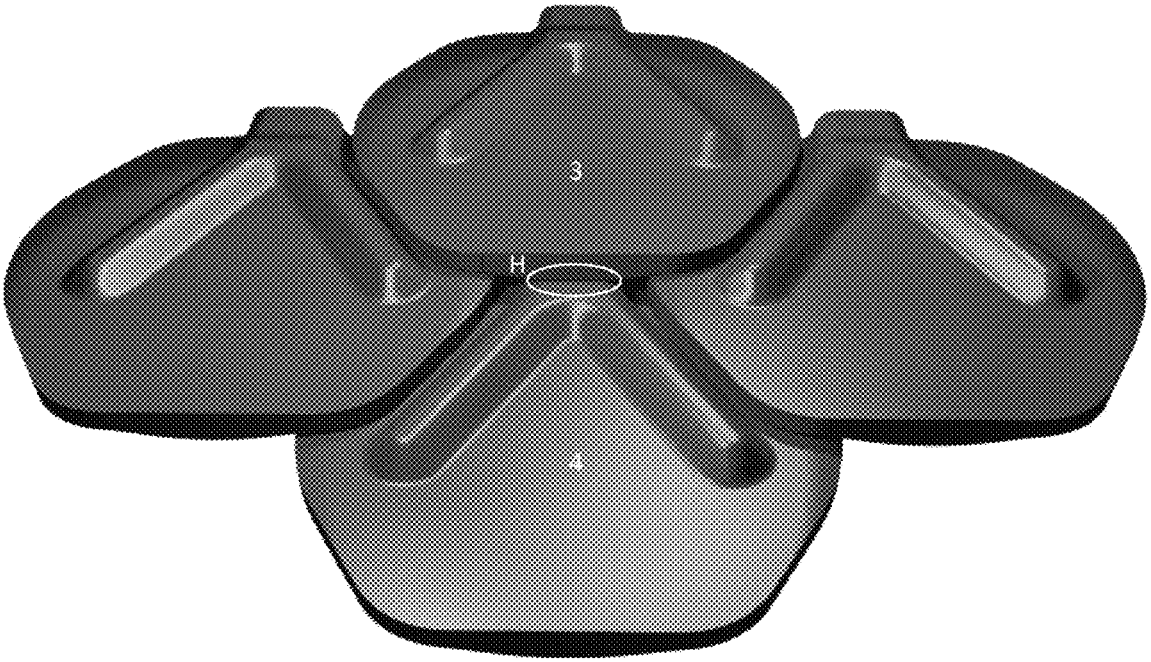
FIG. 3B shows four tiles according to FIG. 2F in an imbricated arrangement, the seam between the upper 3 and lower 4 tiles in a column of tiles being marked with letter H.

Referring to FIG. 3B, at region H, the side edge of the upper tile 3 is partially recessed behind the rear side edge I (FIGS. 2F and 2I) of part of the Y-shaped raised portion C of the lower tile 4. This arrangement provides an effective block against projectiles at various angles of trajectory oriented into this region of the imbricated assembly. Because of the lack of a tooth feature F, along with the depression D beneath the base region of the Y-shaped raised portion C, thicknesses (and weight) in this region are reduced compared to the prior art design.

Figure 4A:
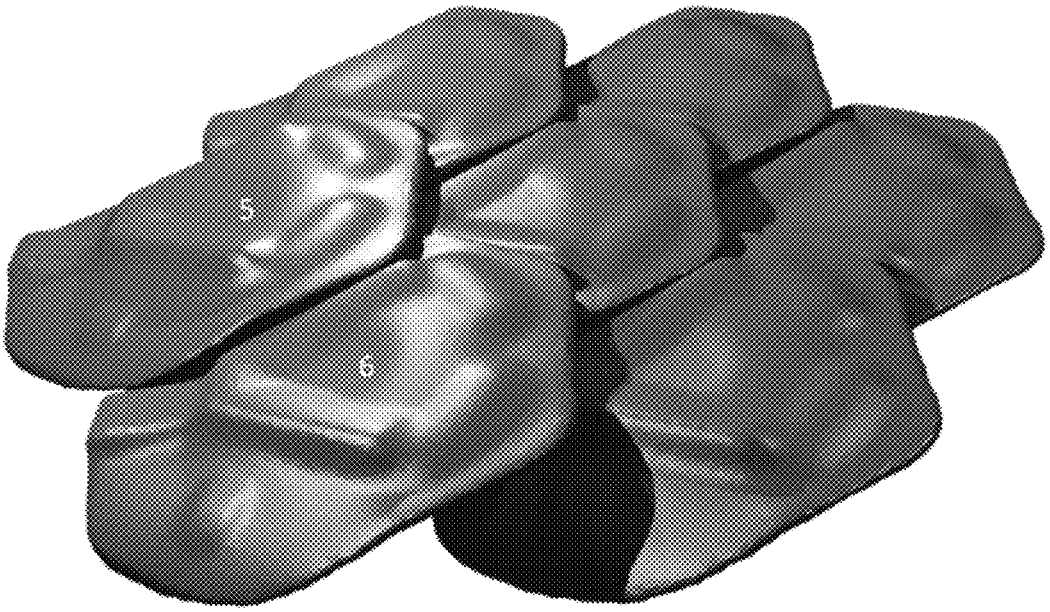
Fig. 4A (prior art)
FIG. 4A shows seven tiles according to FIG. 2A in an imbricated arrangement.
Figure 4B:
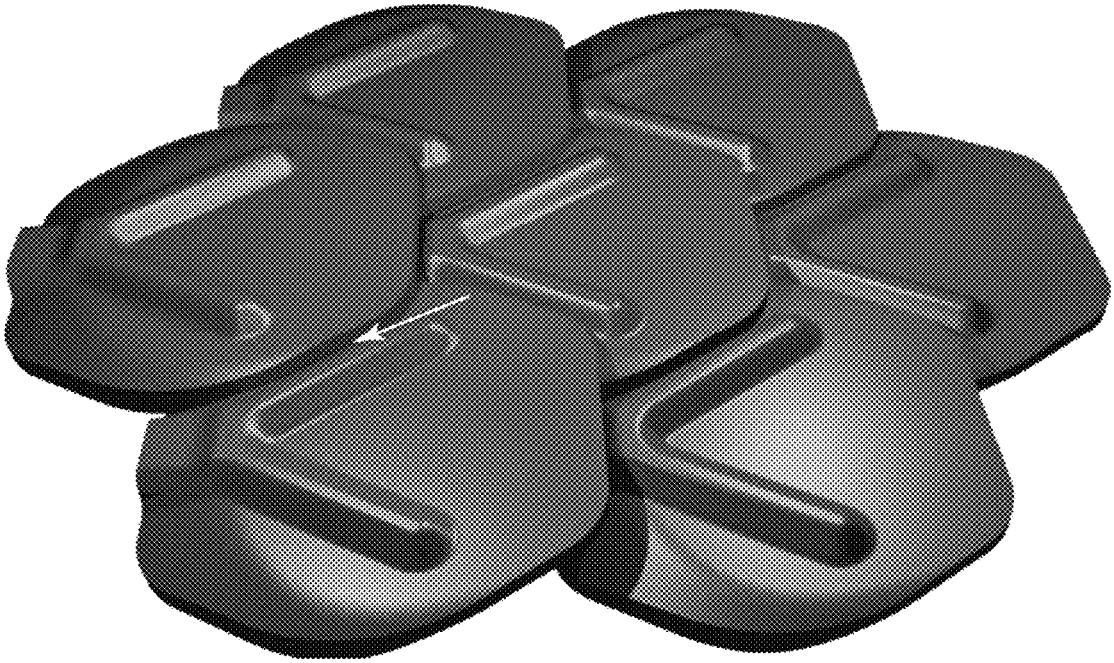
FIG. 4B shows seven tiles according to FIG. 2F in an imbricated arrangement.

Referring to FIG. 4A, contact between neighboring tiles 5 and 6 is by a convex surface J (FIG. 2C) on the wear-face side of the upper tile 5 and a convex surface K (FIG. 2E) on the strike-face side of the lower tile 6. This arrangement allows for limited rocking of one tile relative to the other, making the armor panel conformable, without opening up an oblique gap between the tiles (at locations where the edge of one tile meets the exterior side of one of the limbs of the Y-shaped raised portion C of another tile). A similar principle is applied to the tiles according to the present invention, as depicted in FIG. 4B, though with the contacting geometry of the new design, the oblique coverage (arrow in FIG. 4B) is improved because of the higher elevation of the Y-shaped raised portion C.

Figure 5A:
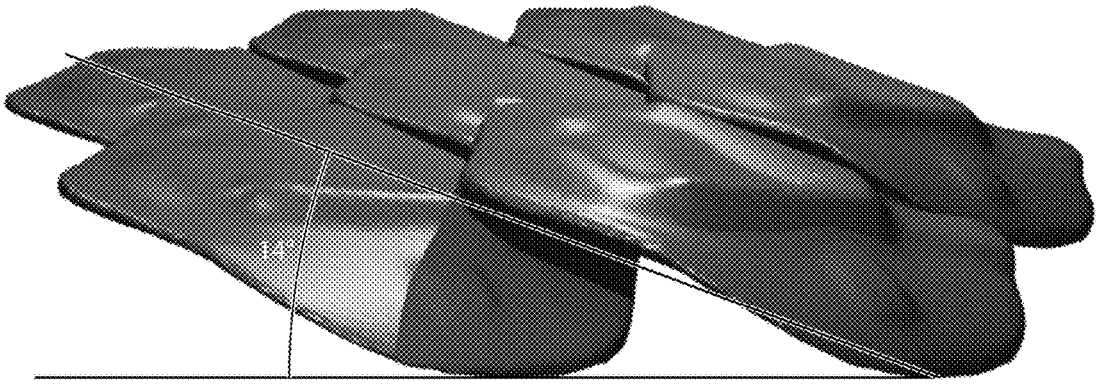
Fig. 5A (prior art)
FIG. 5A shows a side view of the arrangement of FIG. 4A with the angles of incline relative to the wear face contact surface shown.
Figure 5B:
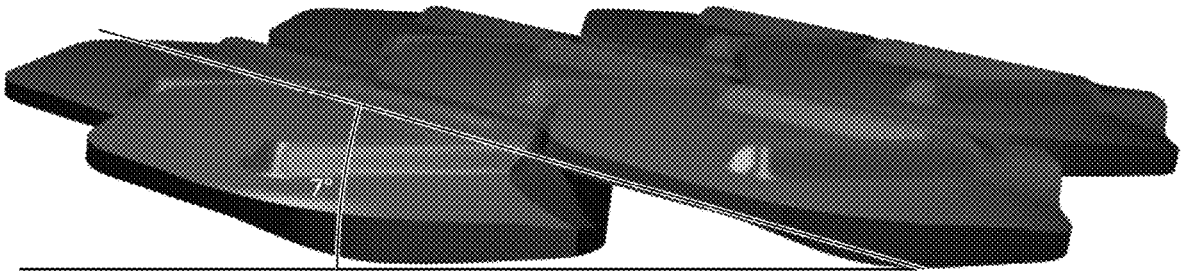
FIG. 5B shows a side view of the arrangement of FIG. 4B with the angles of incline relative to the wear face contact surface shown.

Referring to FIG. 5*a*, the previous design required tiles to be inclined at a 14° angle relative to the orientation they would individually have, resting on the flat wear surface (the surface the wear-face side of the imbricated pattern would rest on). This angle would result in an oblique angle of impact for a bullet propagating orthogonal to the wear face plane, the projectile would turn so that the interaction area between the bullet and the tile would be increased, thus blunting the concentrated force, contributing to the defeat of the projectile. This slanted tile orientation; however, means that the projected area of coverage per tile on the flat wear face plane is diminished by the cosine of the incline angle. As depicted in FIG. 5B, in a tile according to the present invention, the angle of the tiles in the imbricated pattern is shallower, for example, 7°, which over the expanse of an armor panel, results in fewer tiles being needed for the same coverage area, acting to lower the weight of the panel.

Figure 6A:
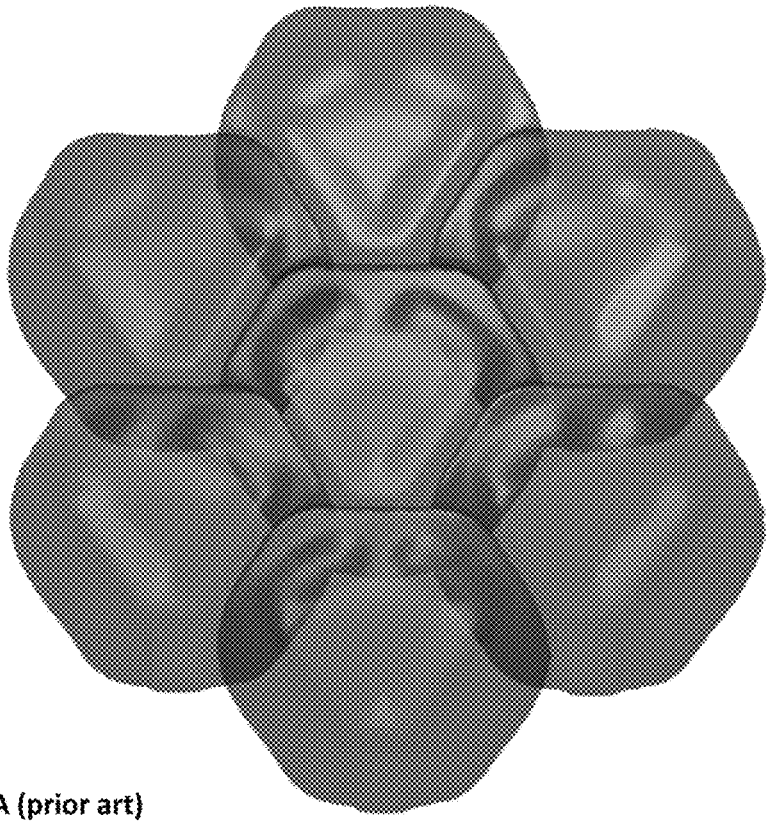
Fig. 6A (prior art)
FIG. 6A shows a top view of the arrangement of FIG. 4A with tiles rendered semitransparent to show the extent of the overlap of the tiles.
Figure 6B:
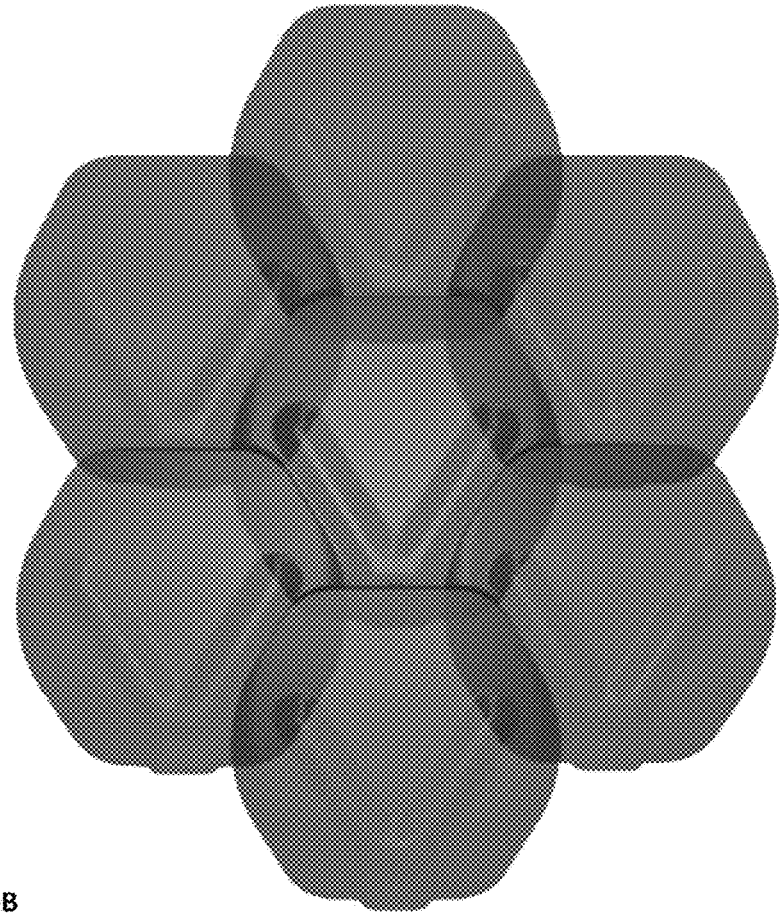
FIG. 6B shows a top view of the arrangement of FIG. 4B with tiles rendered semitransparent to show the extent of the overlap of the tiles.

In comparing the extent of overlap in the imbricated patterns of the prior art design (FIG. 6A) and a tile according to the present invention (FIG. 6B), pixel-wise image analysis shows that in the projected view, there is less tile overlap. For example, the area percent overlap among six tiles in an imbricated pattern with the prior art tile is 25.61, whereas it is 20.58 for a tile according to the present invention, indicating that a tile according to the present invention provides more coverage along the wear face per tile in an imbricated pattern. Consequently, fewer tiles according to the present invention would be needed for the same area coverage.

Figure 7A:
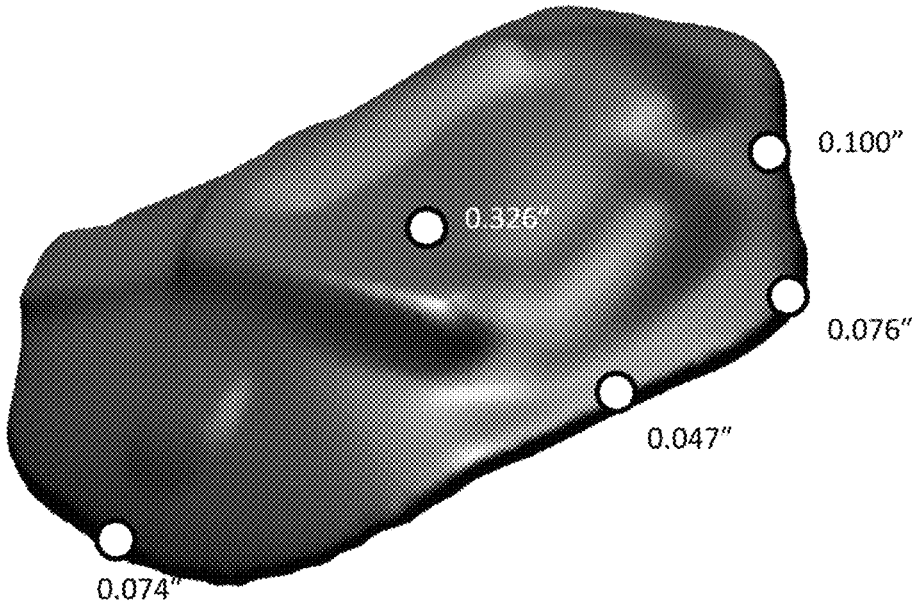
Fig. 7A (prior art)
FIG. 7A shows thickness measurements at indicated locations on a 40 gram sintered boron carbide tile according to the prior art.
Figure 7B:
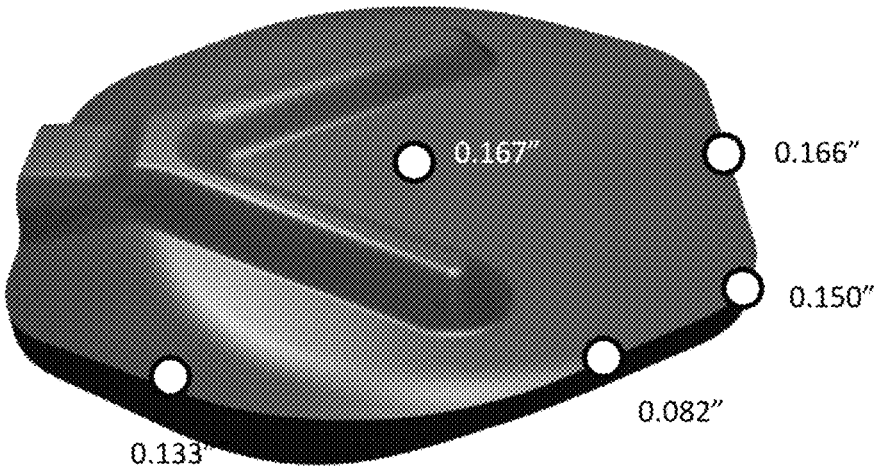
FIG. 7B shows thickness measurements at indicated locations on a 30 gram sintered boron carbide tile according to the present invention.

As depicted in FIGS. 7A and 7B, thickness measurements were taken at the indicated locations of a 40 gram sintered boron carbide tile of the prior art design (FIG. 2A), and a 30 gram sintered boron carbide tile of a design according to the present invention (FIG. 2F). The edge to center thickness ratio for the prior art tile design (FIG. 7A) ranges from 0.14 to 0.31. For a tile according to the present invention, the edge to center thickness ratio ranges from 0.49 to 0.90, which is a substantial thickening of the edges relative to the center compared to the prior art design. Edge to center thickness ratio is the ratio of the measured thickness at an edge location to the thickness measured at the center.

Ballistic Performance

Figure 8:
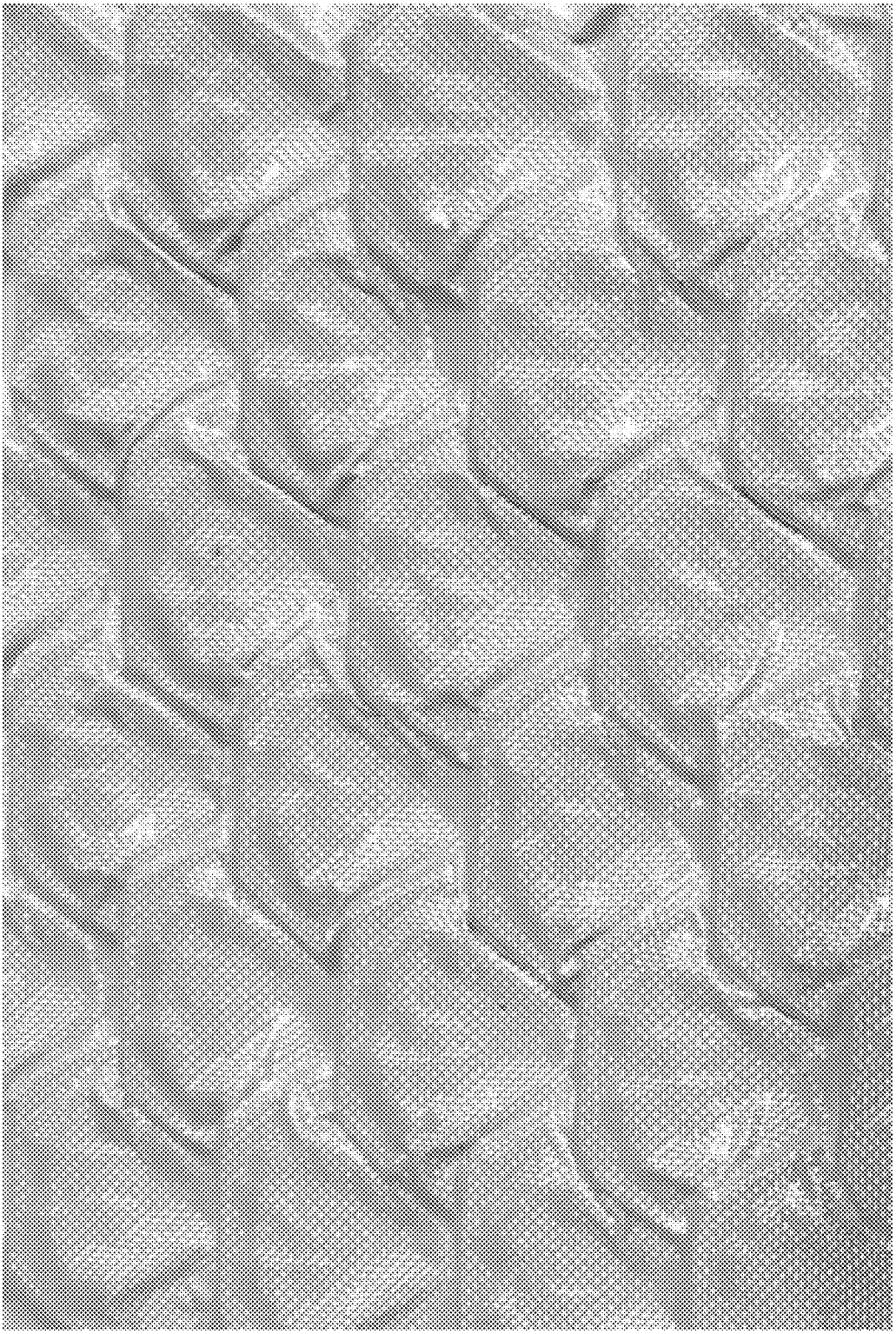
FIG. 8 shows an imbricated arrangement of tiles according to FIG. 2A held in their imbricated pattern by aramid fabric with an adhesive film on the interior surfaces.

For the commercial implementation of the prior art design (FIG. 2A), 40 g sintered boron carbide tiles are wrapped in epoxy-impregnated carbon fiber fabric. The epoxy is set at elevated temperature and pressure. The wrapped tiles are arranged in their imbricated pattern and held in place by encapsulation in adhesive-coated aramid fabric. FIG. 8 shows this encapsulated tile pack arrangement. The encapsulated tile pack (FIG. 8) is sewn to sheets of ballistic fabric (e.g., aramid and/or high molecular weight polyethylene) to obtain a composite system that forms a torso-conformable rifle-protection armor panel (armor panel). The hardness of each ceramic tile at the strike face region acts to blunt and/or fracture the impacting projectile and absorb much of its kinetic energy, while the backing fabric arrests and captures the bullet or its fragments emerging from the locally pulverized ceramic tile. The armor panel has an areal density (weight per unit area) of 6.8 pounds per square foot (psf).

Figure 9:
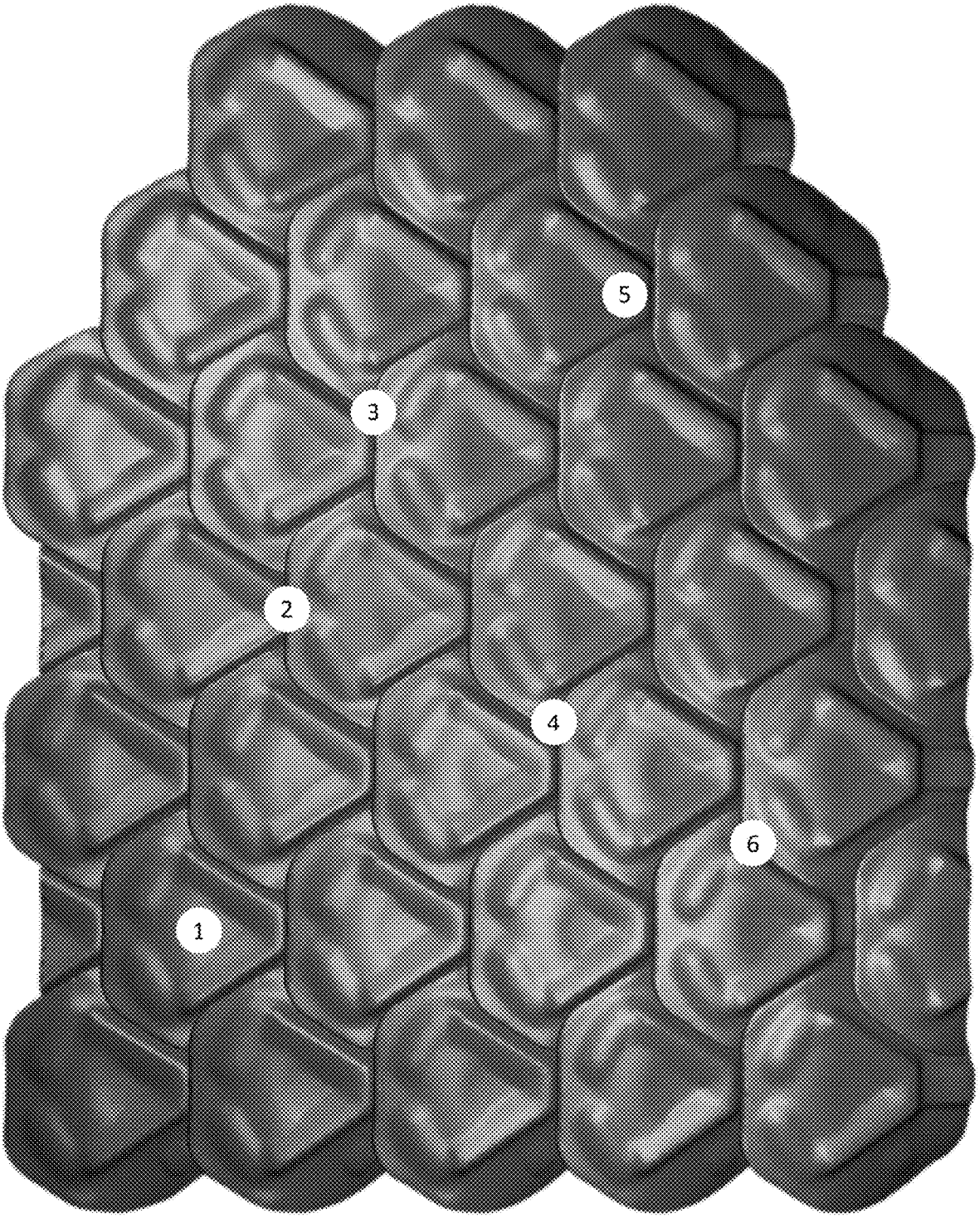
Fig. 9 (prior art)
FIG. 9 shows the vulnerability shot pattern and sequence (in order, from 1 through 6) on an imbricated arrangement of tiles according to FIG. 2A used in a 10"×12" shooters-cut ballistic panel.

The armor panel has been ballistically tested using the shot pattern shown in FIG. 9. The shot pattern shown in FIG. 9 is referred to as a "vulnerability pattern," since the shot locations are varied in an attempt to locate positions of ballistic weakness in the imbricated arrangement. The vulnerability pattern includes tile center shots, two-tile overlap locations, and three-tile overlap locations. Ballistic testing was undertaken with rifle threats of concern to police operators, with six shots per armor panel following the vulnerability pattern, using the same threat for all shots on a given armor panel. Tested threats were the M855, the M43 MSC (mild steel core), and the M80 ball round. Testing was performed at a nationally certified ballistic testing laboratory. All projectiles were shot at their standard muzzle velocities (3020, 2300, and 2800 feet per second, respectively). In all cases, there were no perforations. Armor panels of this design also underwent and passed the National Institute of Justice (NIJ) Level III test (NIJ 0101.06, with Administrative Clarification CTP 2015:01), and are now a NIJ Level III certified armor. The NIJ test is a rigorous test in which each of 38 armor panels undergoes temperature and moisture conditioning, and is shot six times per panel with the M80 ball round, either at muzzle velocity or higher velocities. The panel is shot either orthogonally or at various angles between tiles (e.g., into location E in FIG. 3A).

Ballistic testing of the aforementioned NIJ-certified ballistic panel with threats greater than its intended design (heavier, faster, and/or higher hardness projectiles, typically used for military applications) has shown a greater propensity for perforations in regions of tile overlap than at tile centers. By contrast, ballistic testing with armor panels based on tiles according to the present invention, made of the same sintered boron carbide material as the prior art tiles and arranged to form an armor panel in the same manner as the prior art armor panels described above, showed more uniform ballistic performance at various locations in the imbricated pattern. This improvement in performance uniformity at various locations along the imbricated pattern is in large part because of the relative thinning of tile centers and thickening of tile edges of the tiles according to the present invention.

For the prior art design, attempts to stop the aforementioned important rifle threats at a lighter panel weight requires reducing the weight of the sintered boron carbide tiles, and/or reducing the weight of the ballistic fabric backing behind the encapsulated tile pack. The shape of the tile is formed by uniaxial pressing of granulated powder. This processing method allows for changes in tile weight by varying the extent of powder fill in the pressing die in the range of 40-65 g. Attempting to form lighter tiles suffers from excessive thinning of the edge regions of the tile when the tile weight is reduced below 40 g, making the part difficult to fabricate (part warpage and/or cracking become prevalent), and press die/punch damage more likely. Highly thinned regions of tile overlap become ballistically unsound. On the other hand, retaining the originally-designed 40 g tile, but reducing the weight of ballistic fabric backing also results in projectile perforations, as explained below. For a tile design according to the present invention, made out of the same sintered boron carbide material, the weight range which is feasible to fabricate, while maintaining the designed imbrication features, is 25-45 g.

Figure 10:
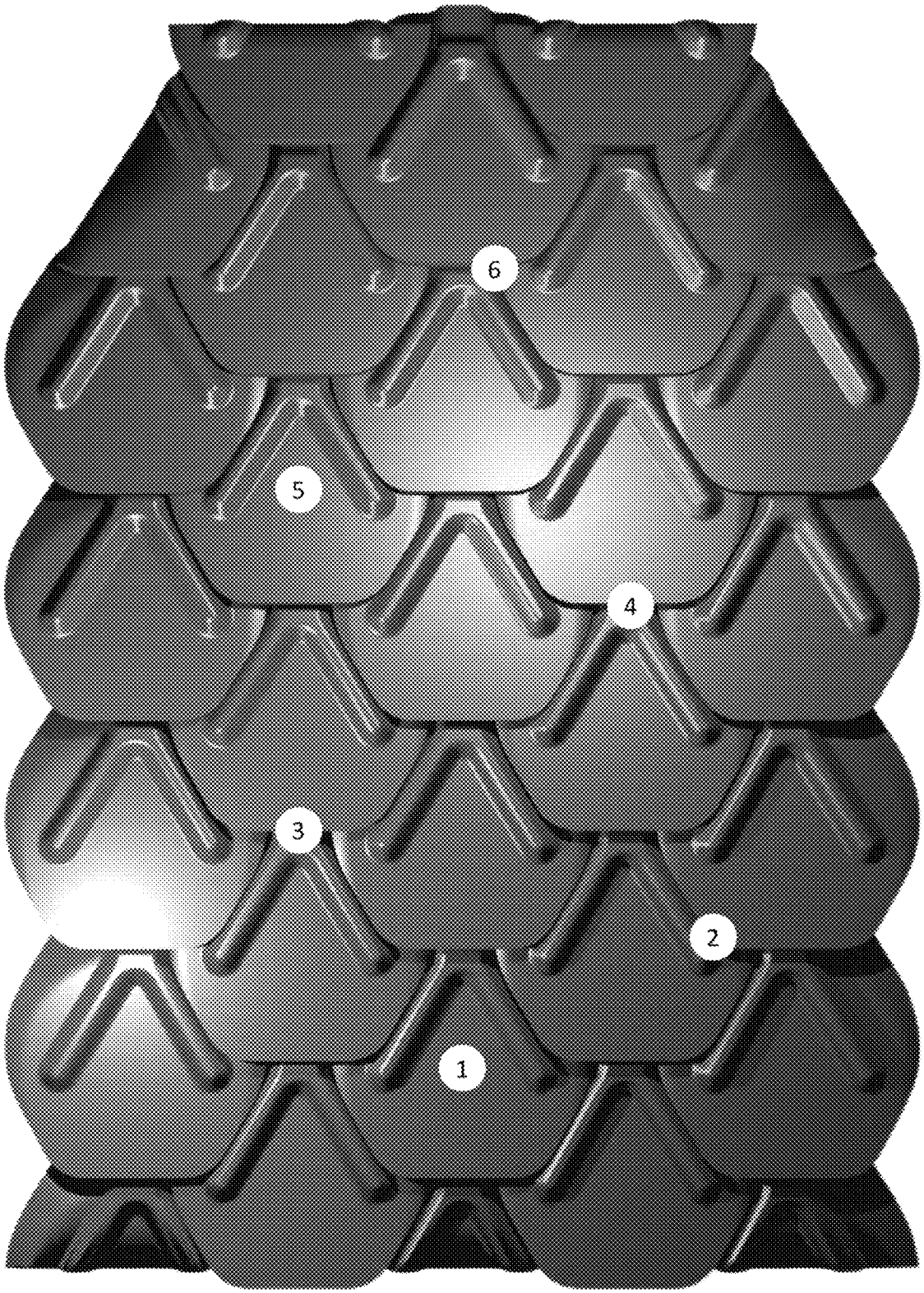
FIG. 10 shows the vulnerability shot pattern and sequence on an imbricated arrangement of tiles according to FIG. 2F in a 10"×12" shooters-cut ballistic panel.

Using this information as background, ballistic tests were performed with the prior art tiles and the tiles according to the present invention. Forty-gram sintered boron carbide tiles of the prior art design, as described above, were used in the construction of Panel A, while thirty-gram sintered boron carbide tiles of the design according to the present invention, as described above, were used in the construction of Panel B. For both, tiles were wrapped in the same way with the same epoxy-impregnated carbon fiber. Both imbricated patterns were encapsulated in the same way using the same adhesive-coated aramid fabric. To make up the same total panel weight (5.25 psf), Panel A had 0.7 psf of backing fabric (30 sheets of high molecular weight polyethylene), while Panel B had 2.3 psf of backing fabric (95 sheets of the same high molecular weight polyethylene). The vulnerability shot pattern for Panel B is shown in FIG. 10. While the orientations of the tiles for the two panels are different, the choices of shot locations resulted in evaluation of the same type of imbricated panel vulnerabilities in the two cases.

The ballistic results from shooting Panel A and Panel B, each six times with a M80 ball projectile at standard muzzle velocity, at a nationally-certified ballistic testing laboratory, are shown in FIGS. 11 and 12. As can be seen, Panel A suffered five perforations out of six shots, while all six bullets were defeated by Panel B.

For a standard medium-sized (10"×12" with angular cutouts at the top forming a "shooter's cut") ballistic armor panel used to protect the front torso, the NIJ-certified panel using the prior art tile design (which successfully stops the M80 ball projectile) weighs 4.9 lbs. By contrast, the equal-area panel using the tiles according to the present invention, yielding the favorable ballistic results in FIG. 12, weighs 3.9 lbs. This difference in weight is significant for police operators who typically wear their rifle protection armor for extended periods of time.

Curved Tiles

FIGS. 1A-1D show a comparison of the dimensions of the prior art "flat" tile (FIG. 1A), the prior art curved tile (FIG. 1B), a flat tile design according to the present invention (FIG. 1C), and a curved tile according to the present invention (FIG. 1D). FIGS. 13A-13J show varying views of the prior art curved tile and a curved tile according to the present invention, both tilted at the angles they would be at in an imbricated pattern (10° for the prior art curved tile design, and 7° for the curved tile according to the present invention).

Figure 14A:
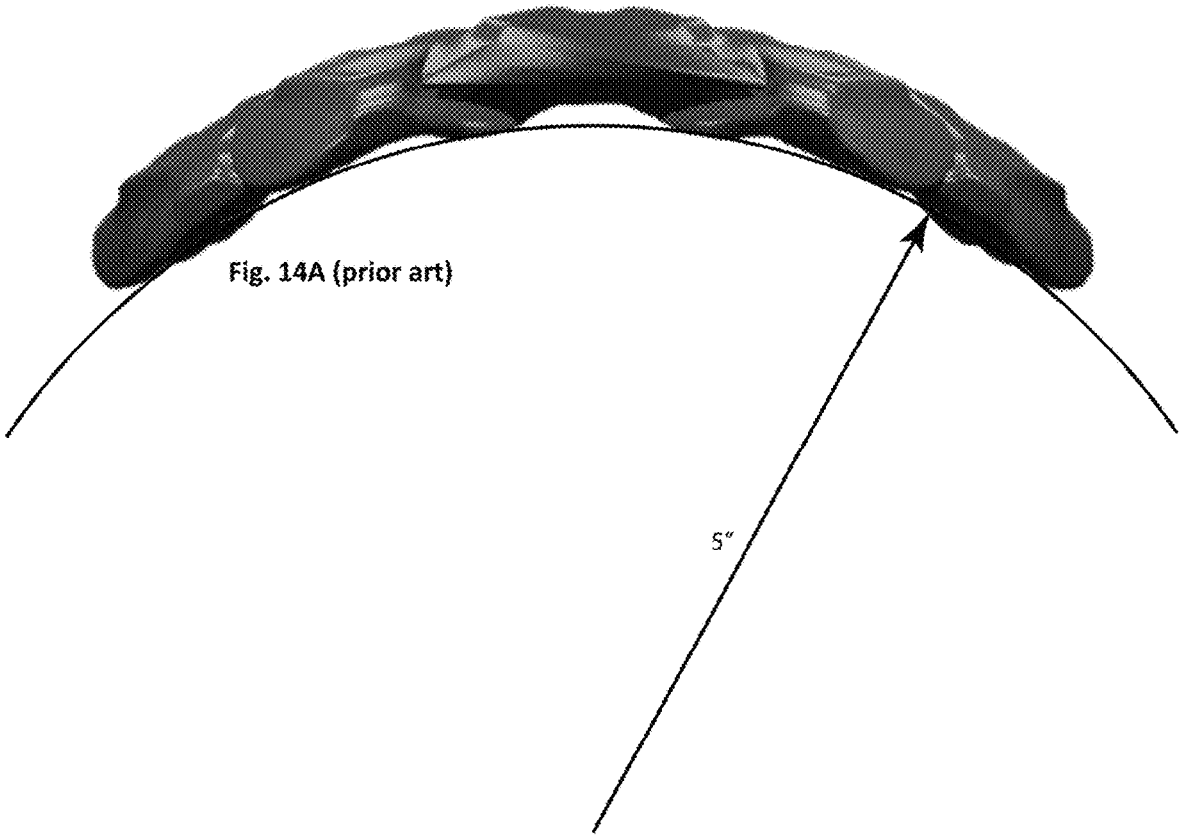
Fig. 14A (prior art)
FIG. 14A shows a front view of an imbricated pattern of tiles according to FIG. 13A following a 5" radius of curvature.
Figure 14B:
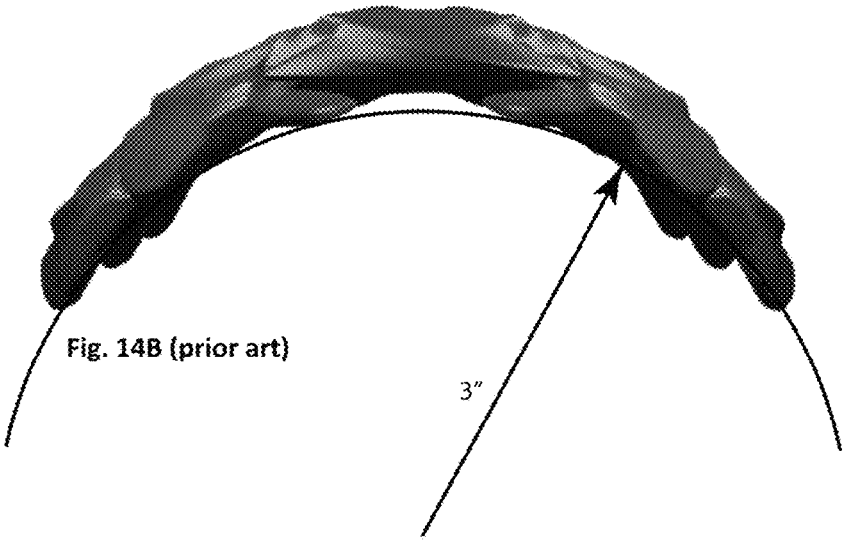
Fig. 14B (prior art)
FIG. 14B shows a front view of an imbricated pattern of tiles according to FIG. 13A following a 3" radius of curvature.

The essential design change in the curved tiles (FIGS. 1B and 1D) over a flat tile (FIGS. 1A and 1C) is that surfaces outside of the Y-shaped raised portions C (FIGS. 2A, 2D, 2E), slope more steeply toward the peripheral edges. As shown in FIGS. 14A and 14B (prior art design), and FIGS. 15A and 15B (prior art design), and FIGS. 16A and 16B (design according to the present invention), and 17A and 17B (design according to the present invention), the more downwardly sloping surfaces allow the imbricated array to follow a relatively small radius of curvature without oblique gaps opening up in the imbricated pattern. Such an imbricated array can follow a contour with a radius of curvature in the range of 2 to 6 inches. A contour with a larger radius of curvature may be followed by using flat and curved tiles in alternating columns.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A tile comprising:

an obverse face;

a reverse face opposite the obverse face; and an endless edge between the obverse face and the reverse face, the endless edge being defined by a plurality of peripheral boundaries connected by curved sections, wherein the obverse face includes a first region and a second region each configured to be overlapped by a corresponding region of a reverse face of another tile, and a strike face region that is not overlapped by another tile, the first region and the second region being adjacent to the non-overlapped strike face region, the strike face region including a Y-shaped raised portion and no other raised portion or recessed portion, and the reverse face including a Y-shaped depression at a location corresponding to the location of the Y-shaped raised portion, and no other depression or raised portion.

2. The tile of claim 1, wherein the tile is symmetric about a center line that divides the Y-shaped raised portion into two symmetric portions.

3. The tile of claim 1, wherein the first region and the second region each slopes downwardly from the strike face region toward respective first and second peripheral boundaries and each is overlapped by corresponding regions of a respective tile when the tile and the respective tiles are arranged in an imbricated arrangement.

4. The tile of claim 1, wherein the tile is comprised of sintered boron carbide.

5. The tile of claim 1, wherein the tile is comprised of sintered silicon carbide.

6. The tile of claim 1, wherein the Y-shaped raised portion is raised high enough to intercept a projectile travelling at an oblique angle to protect a seam defined by a tile overlapping the first region or the second region.

7. The tile of claim 1, wherein the first region and the second region slope at an inclination that would permit assembly of an imbricated arrangement of additional tiles, each additional tile being identical to the tile, and a first tile of the additional tiles overlaps the first region and a second tile of the additional tiles overlaps the second region.

8. The tile of claim 1, wherein the imbricated arrangement can follow a curved contour with a radius of curvature in the range of two to six inches.

9. The tile of claim 1, wherein the tile has an edge to center thickness ratio in the range 0.49 to 0.90.

10. An armor comprising a plurality of tiles cooperatively arranged to realize a flexible body, each tile comprising an obverse face, a reverse face opposite the obverse face, and an endless edge between the obverse face and the reverse face, the endless edge being defined by a plurality of peripheral boundaries connected by curved sections, wherein the obverse face includes a first region and a second region each configured to be overlapped by a corresponding region of a reverse face of a respective tile from the plurality of tiles, and a strike face region that is not overlapped by another tile from the plurality of tiles, the first region and the second region being adjacent to the non-overlapped strike face region, the strike face region including a Y-shaped raised portion and no other raised portion or recessed portion, and the reverse face including a Y-shaped depression at a location corresponding to the location of the Y-shaped raised portion, and no other depression or raised portion.

11. The armor of claim 10, wherein the first region and the second region each slopes downwardly from the strike face region toward respective first and second peripheral boundaries and each is overlapped by a corresponding region on the reverse face of a respective tile from the plurality of tiles.

12. The armor of claim 10, wherein the tiles may be comprised of sintered boron carbide.

13. The armor of claim 10, wherein the tiles may be comprised of sintered silicon carbide.

14. The armor of claim 10, wherein the armor arrangement is configured as an armor blanket.

15. The armor of claim 10, wherein each tile is wrapped in an epoxy-impregnated carbon fiber fabric, and the wrapped tiles are arranged in an imbricated pattern and held in place by encapsulation in an adhesive-coated aramid fabric.

16. The armor of claim 10, wherein the Y-shaped raised portion is raised high enough to intercept a projectile travelling at an oblique angle to protect a seam defined by a tile overlapping the first region or the second region.

17. The armor of claim 10, wherein the first and the second regions are sloped to permit an arrangement that can follow a curved contour with a radius of curvature in the range of two to six inches.

18. The armor of claim 10, wherein each tile has an edge to center thickness ratio in the range 0.49 to 0.90.

* * * * *